US007399508B2

(12) United States Patent
Tsujihata et al.

(10) Patent No.: US 7,399,508 B2
(45) **Date of Patent: *Jul. 15, 2008**

(54) RECORDING MEDIUM

(75) Inventors: Shigetomo Tsujihata, Shizuoka-ken (JP); Masanobu Takashima, Shizuoka-ken (JP); Shinichiro Serizawa, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 324 days.

This patent is subject to a terminal disclaimer.

(21) Appl. No.: 10/853,359

(22) Filed: May 26, 2004

(65) Prior Publication Data

US 2004/0241347 A1 Dec. 2, 2004

(30) Foreign Application Priority Data

May 26, 2003 (JP) ..... 2003-147528
Feb. 5, 2004 (JP) ..... 2004-029633

(51) Int. Cl.
*B41M 5/40* (2006.01)

(52) U.S. Cl. ..... 428/32.26; 428/32.38; 428/32.28; 428/32.3; 428/32.31; 428/32.34

(58) Field of Classification Search ..... 428/32.26, 428/32.28, 32.3, 32.31, 32.34, 32.38
See application file for complete search history.

(56) References Cited

U.S. PATENT DOCUMENTS

| | | | | |
|---|---|---|---|---|
| 6,037,050 | A | 3/2000 | Saito et al. | |
| 6,165,606 | A | 12/2000 | Kasahara et al. | |
| 6,338,891 | B1 | 1/2002 | Kawasaki et al. | |
| 2002/0107301 | A1 | 8/2002 | Yamanouchi et al. | |
| 2003/0068476 | A1* | 4/2003 | Yamada et al. | 428/195 |
| 2003/0138605 | A1 | 7/2003 | Landry-Coltrain et al. | |
| 2004/0246321 | A1* | 12/2004 | Takashima et al. | 347/100 |

FOREIGN PATENT DOCUMENTS

| | | | |
|---|---|---|---|
| EP | 1138509 | A2 | 10/2001 |
| EP | 1 195 259 | A2 | 4/2002 |
| EP | 1 219 459 | A2 | 7/2002 |
| EP | 1 253 021 | A2 | 10/2002 |
| EP | 1285774 | A2 | 2/2003 |
| EP | 1 340 796 | A1 | 9/2003 |
| EP | 1 352 754 | A2 | 10/2003 |
| EP | 1 426 194 | A2 | 6/2004 |
| JP | 63-260477 | A | 10/1988 |
| JP | 64-36479 | A | 2/1989 |
| JP | 1-115677 | A | 5/1989 |
| JP | 07-314882 | A | 12/1995 |
| JP | 10-119423 | A | 5/1998 |
| JP | 10-217601 | A | 8/1998 |
| JP | 11-58941 | A | 3/1999 |
| JP | 11-268406 | A | 10/1999 |
| JP | 2000-303009 | A | 10/2000 |
| JP | 2001-260519 | A | 9/2001 |
| JP | 2001-270227 | A | 10/2001 |
| JP | 2001-315432 | A | 11/2001 |
| JP | 2002-36717 | A | 2/2002 |
| JP | 2002-86904 | A | 3/2002 |
| JP | 2003-54118 | A | 2/2003 |
| WO | WO 02-083795 | A2 | 10/2002 |

* cited by examiner

*Primary Examiner*—Betelhem Shewareged
(74) *Attorney, Agent, or Firm*—Sughrue Mion, PLLC

(57) ABSTRACT

The present invention provides a recording medium including a recording layer on a substrate, wherein the recording layer includes a polymer that has a thioether bond, has a sulfur equivalent of no less than 1.2 meq/g, and has an inorganic/organic ratio (I/O value) represented in an organic-inorganic conceptional diagram of no less than 0.5. According to the invention, the recording medium may be an ink jet recording medium, in which the recording layer is an ink receiving layer.

16 Claims, No Drawings

RECORDING MEDIUM

CROSS REFERENCE TO RELATED APPLICATIONS

This application claims priority under 35 USC 119 from Japanese Patent Application Nos. 2003-147528 and 2004-29633, the disclosure of which is incorporated by reference herein.

BACKGROUND OF THE INVENTION

1. Field of the Invention

The present invention relates to a recording medium used for ink jet recording methods, thermosensitive recording methods, pressure sensitive recording methods, photosensitive recording methods and transfer recording methods, and particularly for ink jet recording methods. In particular, the invention relates to a recording medium that is excellent in ink receptivity, glossiness and light fastness, while having little bleeding and color fading over time in an image portion.

2. Description of the Related Art

Various information processing systems have been developed in recent years along with rapid progress in information technology industries, and recording methods and recording apparatuses suitable for these information processing systems have been developed for practical uses.

Examples of such practically used recording methods include electrophotographic methods, ink jet recording methods, thermosensitive recording methods, pressure sensitive recording methods and thermal transfer recording methods in addition to silver salt photographic recording methods. A high quality image with a sharp image and clear color is required in any of the recording methods described above.

Among these recording methods, the ink jet recording method has been widely used in offices as well as in homes, since this method is advantageous in that it can be used to record on various recording materials, in that hardware (apparatus) therefor is inexpensive and compact, and in that the method is very quiet.

Since resolution of ink jet printers has increased in recent years, obtaining "photorealistic" high quality recorded materials has become possible, and various kinds of ink jet recording sheets have been developed along with such improvement in hardware (apparatus).

Required characteristics for these ink jet printing sheets are generally: (1) rapid drying (rapid ink-absorption speed), (2) proper and uniform diameter of ink dots (no bleeding), (3) good granularity, (4) high circularity of dots, (5) high color density, (6) high chroma (free of dullness), (7) good water resistance, light fastness and ozone resistance of printed portions, (8) high brightness of recording sheets, (9) good storability of recording sheets (no yellowing or bleeding of images in long term storage (excellent in prevention of bleeding over time), (10) substantially no deformation with good dimensional stability (sufficiently small curling), and (11) good running property of hardware.

In the use of photographic glossy paper sheets used for obtaining photorealistic high quality printed material, in addition to the various aforementioned characteristics, the recording sheets are also required to have glossiness, glossiness of printed portions, surface smoothness and texture of printed paper sheets resembling that of silver salt photographs.

An ink jet recording medium having a porous structure in an ink receiving layer has been developed and practically used in recent years for improving the various characteristics described above. Such an ink jet recording medium is excellent in ink receptivity (instantaneous drying ability) while having high glossiness, due to providing the porous structure.

An ink jet recording medium comprising fine inorganic pigment particles and a water soluble resin as well as an ink receiving layer having a high void ratio provided on a substrate has been proposed (for example, see Japanese Patent Application Laid-Open (JP-A) Nos. 10-119423 and 10-217601).

These recording sheets, and particularly an ink jet recording medium having the ink receiving layer comprising a porous structure using silica as fine inorganic pigment particles, are excellent in ink absorbing property due to their construction. Accordingly, the ink jet recording medium has excellent ink absorptivity and a high ink receptivity capable of forming a high resolution image, while the medium exhibits high glossiness.

However, the recording medium has a large oxygen permeability due to its porous coated layer, and deterioration of components in the ink receiving layer may be accelerated. Furthermore, image bleeding over time may occur in accordance with adsorption of moisture on the silica surface.

Small amounts of gases in the air, particularly ozone, cause color fading of a recorded image over time. Since the recording material comprising the ink receiving layer having the porous structure contains many voids, the recorded image is readily faded with the ozone gas in the air. Consequently, fastness against ozone in the air (ozone resistance) is a crucial characteristic for the recording material having the ink receiving layer of the porous structure.

Recording materials in which sulfur-containing compounds such as anti-color fading agents are added in the ink receiving layer for improving various characteristics have been frequently reported.

For example, JP-A Nos. 64-36479 and 1-115677 have proposed ink jet recording media containing thioether compounds.

However, the compounds exemplified in JP-A Nos. 64-36479 and 1-115677 are hydrophobic low-molecular weight compounds and therefore are water insoluble. Accordingly, it is difficult to mix the compounds with coating liquids, and glossiness of the ink jet recording medium is deteriorated even when these compounds are added as emulsions.

JP-A Nos. 2002-86904 and 2002-36717 have proposed to use thioether compounds having hydrophilic groups.

However, while the compounds exemplified in JP-A Nos. 2002-86904 and 2002-36717 exhibit ozone resistance, bleeding over time becomes worse under high-temperature/high-humidity conditions since the compounds are hydrophilic low-molecular weight compounds. Moreover, since most of such compounds have low melting points, there has also been a problem in that the thioether compound is precipitated on the surface of the recording sheet when stored in a low temperature environment at, for example, 5° C. or lower for one week.

Although polysulfide compounds (disulfide and trisulfide compounds with a molecular weight of less than 1,000) have been used, for example, in JP-A No. 2001-315432, these compounds do not exhibit a sufficient effect for enhancing ozone resistance.

JP-A Nos. 11-58941 and 63-260477 have proposed polymer compounds containing thioether bonds.

However, the ozone resistance improving effect of the compounds exemplified in JP-A Nos. 11-58941 and 63-260477 (and similar compounds) is also insufficient since the sulfur content is low (1 meq/g or less) in the polymer.

JP-A Nos. 11-268406 and 2001-270227 have proposed cationic polyaddition polymers synthesized using specific thioethers.

However, although water resistance is improved by adding the cationic polyaddition polymers in the ink receiving layer, ozone resistance is still insufficient.

JP-A No. 2003-54118 has proposed specific polymer compounds.

However, since the polymer compounds described in JP-A No. 2003-54118 are formed into organic particles having Tg of 70° C. or more, glossiness of the layer is decreased.

SUMMARY OF THE INVENTION

The present invention has been made in light of the above-mentioned circumstances. The invention is to provide a recording medium that is able to form high resolution images at high density, that generates no bleeding over time even when subjected to long-term storage in a high-temperature/high-humidity environment after printing, and that has an excellent effect for preventing color fading due to ozone gas in the air.

The inventors have carried out intensive studies, and have thus completed the invention.

A first aspect of the invention is to provide a recording medium comprising a recording layer on a substrate, in which the recording layer comprises at least one polymer that has a thioether bond, has a sulfur equivalent of no less than 1.2 meq/g, and has an inorganic/organic ratio (I/O value) represented in an organic-inorganic conceptional diagram of no less than 0.5.

Another aspect of the invention is to provide a recording medium serving as an ink jet recording medium comprising an ink receiving layer as a recording layer on a substrate, in which the ink receiving layer comprises at least one polymer that has a thioether bond, has a sulfur equivalent of no less than 1.2 meq/g, and has an inorganic/organic ratio (I/O value) represented in an organic-inorganic conceptional diagram of no less than 0.5.

DETAILED DESCRIPTION OF THE INVENTION

The present invention provides a recording medium comprising a recording layer on a substrate. The recording layer comprises at least one polymer that has a thioether bond, has a sulfur equivalent of 1.2 meq/g or more, and has an inorganic/organic ratio (I/O value) represented by an organic-inorganic conceptional diagram of 0.5 or more. In particular, the recording medium is preferably an ink jet recording medium comprising the recording layer as an ink receiving layer.

The ink jet recording medium may contain fine particles or a water soluble resin, if necessary. The ink jet recording medium will be described below.

<Ink Receiving Layer (Recording Layer)>

(Polymer)

The polymer used for the ink receiving layer (recording layer) of the ink jet recording medium has thioether bonds, has a sulfur equivalent of no less than 1.2 meq/g, and has an inorganic/organic ratio (I/O value) represented by an organic-inorganic conceptional diagram of no less than 0.5 (sometimes referred to as "polymer of the invention" hereinafter).

The sulfur equivalent as used herein refers to the equivalent (mmol) of sulfur atoms contained in 1 g of the polymer, and is represented by meq/g. For example, when a compound having a molecular weight of 1000 contains 1 mole of the sulfur atoms, the sulfur equivalent is represented as 1 meq/g.

The polymer of the invention has a sulfur equivalent of no less than 1.2 meq/g, particularly preferably no less than 3 meq/g. The ozone resistance effect is insufficient when the sulfur content is less than 1.2 meq/g.

The inorganic/organic ratio (I/O value) represented by the organic-inorganic conceptional diagram refers to a parameter representing an hydrophilicity/lipophilicity scale of a compound or substituent, and detailed explanations thereof are described in "Organic Conceptional Diagram" by Yoshio Kohda, Sankyo Publishing Co., 1984. The letter "I" and "O" represent inorganicity and organicity, respectively, and a larger I/O value represents larger inorganicity (higher polarity and hydrophilicity). The polymer of the invention is required to have the I/O value of 0.5 or more, preferably 0.7 or more and 3.0 or less, and more preferably 0.8 or more and 2.5 or less. Glossiness of the surface of an imaging layer as well as handling ability of the recording sheet are decreased when the I/O value is less than 0.5.

The I/O value is one of functional group contribution methods by which the parameters are determined for every functional groups, and the inorganicity and organicity are shown for each functional group. The constituting functional groups of the polymer of the invention should be determined according to this parameter. The compounds for forming such polymer may be selected from known compounds.

The polymer of the invention preferably has a partial structure represented by the following formula (1):

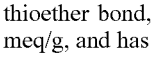

P—Y—S— Formula (1)

In the formula (1), P represents a polymer residue or an oligomer residue having a repeating unit. Y represents a single bond or a divalent linking group.

Preferable examples of the polymer residue or oligomer residue include (meth)acrylic acid polymers, (meth)acrylate ester polymers, (meth)acrylamide polymers, (meth)-N-substituted-acrylamide polymers, aromatic vinyl polymers, vinyl ester polymers, halogenated vinyl polymers, cyanated vinyl polymers and diene compound polymers.

Preferable examples of the divalent linking group include an ether bond, an ester bond, a thioester bond, a carbonate ester bond, a carbamoyl group, an alkylene group (for example a methylene, ethylene, propylene, trimethylene, tetramethylene, hexamethylene or octamethylene group) and an arylene group (for example phenylene group), or a combination thereof.

The term "(meth)acryl" as used in the specification means "acryl" or "methacryl".

The polymer of the invention also preferably has a partial structure represented by the following formula (2):

Formula (2)

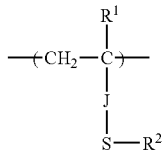

In the formula (2), $R^1$ represents a hydrogen atom or methyl group. J represents a single bond or a divalent linking group. Examples of the divalent linking group represented by J includes an alkylene group (for example a methylene group, an ethylene group, a trimethylene group, a tetramethylene group, a hexamethylene group, a cyclohexylene group or a 2-hydroxypropylene group), an arylene group (for example a phenylene group), an ether bond, an ester bond, a thioether bond, a thioester bond, a carbonic ester bond and an amide bond, and a linking group comprising a combination of plurality of them.

$R^2$ represents an alkyl or aryl group. The alkyl group represented by $R^2$ is preferably an alkyl group having 1 to 18 carbon atoms, more preferably 1 to 12. Specific examples thereof include a methyl group, an ethyl group, a n-propyl group, an isopropyl group, a n-butyl group, a t-butyl group, a n-hexyl group, a cyclohexyl group, a n-octyl group, a 2-ethylhexyl group, a decyl group, and a dodecyl group. These alkyl groups may further have a substituent (for example a hydroxyl group, a carboxyl group, a sulfo group, an alkyloxycarbonyl group, a carbamoyl group, a sulfamoyl group, a cyano group, an amino group, an alkoxy group and a phenyl group), an ester bond, an ether bond or an amino bond.

The aryl group represented by $R^2$ is preferably an aryl group having 6 to 12 carbon atoms. Specific examples thereof include a phenyl group and a naphthyl group, and these aryl groups may further have a substituent.

It is -preferable that R 2is an unsubstituted alkyl group having 1 to 12 carbon atoms or the aforementioned alkyl group further having a substituent (for example, a hydroxyl group, a carboxyl group or a sulfo group). Specific preferable examples of $R^2$ include a methyl group, an ethyl group, a hydroxyethyl group, a 2,3-dihydroxypropyl group, a 2-carboxyethtyl group, a 3-carboxypropyl group and a 3-sulfoxypropyl group.

The polymer of the invention preferably has a hydrophilic group. Preferable examples of hydrophilic group include a hydroxyl group, a carboxyl group, a sulfo group, a carbamoyl group, a sulfamoyl group, an amino group, an ammonio group and an amidino group. A hydroxyl group, an ammonio group, an amino group and a carbamoyl group are particularly preferable.

The polymer of the invention preferably has a partial structure represented by the following formula (3):

Formula (3)

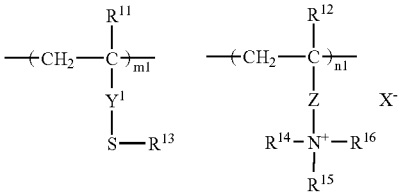

In the formula (3), $R^{11}$ and $R^{12}$ each independently represent a hydrogen atom or a methyl group. $R^{13}$ represent an alkyl group or an aryl group. $R^{14}$, $R^{15}$ and $R^{16}$ each independently represent a hydrogen atom or an alkyl group. $Y^1$ and Z each independently represent a divalent linking group. $m^1$ and $n^1$ represent percentages by mole of repeating units in the polymer and satisfy relationships of $10 \leqq m^1 \leqq 95$ and $5 \leqq n^1 \leqq 90$. $X^-$ represents a counter-anion.

$R^{13}$ in the formula (3) represents an alkyl group or an aryl group.

The alkyl group represented by $R^{13}$ is preferably an alkyl group having 1 to 18 carbon atoms, more preferably 1 to 12. Specific examples thereof include methyl, ethyl, n-propyl, isopropyl, n-butyl, t-butyl, n-hexyl, cyclohexyl, n-octyl, 2-ethylhexyl, decyl and dodecyl groups. These alkyl groups may further have a substituent (for example, a hydroxyl group, a carboxyl group, a sulfo group, an alkyloxycarbonyl group, a carbamoyl group, a sulfamoyl group, a cyano group, an amino group, an alkoxy group and a phenyl group), an ester bond, ether bond and amide bond.

The aryl group represented by $R^{13}$ is preferably an aryl group having 6 to 12 carbon atoms. Specific examples thereof include a phenyl group and a naphthyl group, and these aryl groups may further have a substituent.

It is preferable that $R^{13}$ is an unsubstituted alkyl group having 1 to 12 carbon atoms or the aforementioned alkyl group further having a substituent (for example, a hydroxyl group, a carboxyl group or a sulfo group). Specific preferable examples of $R^{13}$ include a methyl group, an ethyl group, a hydroxyethyl group, a 2,3-dihydroxypropyl group, a 2-carboxyethyl group, a 3-carboxypropyl group and a 3-sulfoxypropyl group.

Examples of the alkyl group represented by $R^{14}$, $R^{15}$ and $R^{16}$ are the same as those represented by $R^{13}$.

$R^{14}$, $R^{15}$ and $R^{16}$ are preferably a hydrogen atom, a methyl group and an ethyl group.

$X^-$ in the formula (3) represents a counter-anion. Examples of the counter-anion represented by $X^-$ include halogen ions ($Cl^-$, $Br^-$, $I^-$), sulfonic acid ion, alkylsulfonate ion, arylsulfonate ion, alkylcarboxylate ion and arylcarboxylate ion.

$Y^1$ and Z in the formula (3) each independently represent a divalent linking group. Examples of the divalent linking group represented by $Y^1$ or Z include an alkylene group (for example a methylene group, an ethylene group, a trimethylene group, a tetramethylene group, a hexamethylene group, a cyclohexylene group and a2-hydroxypropylene group), an arylene group (for example a phenylene group), a (thio)ether bond, a (thio)ester bond and an amide bond, and a linking group comprising a combination of a plurality of them.

$m^1$ and $n^1$ in the formula (3) represent percentages by mol of repeating units in the polymer and satisfy the relationships of $10 \leqq m^1 \leqq 95$ and $5 \leqq n^1 \leqq 90$, respectively, preferably $50 \leqq m^1 \leqq 95$ and $5 \leqq n^1 \leqq 50$, respectively. Color fading due to Ozone in air is remarkably prevented when $m^1$ and $n^1$ are in the range of $10 \leqq m^1 \leqq 95$ and $5 \leqq n^1 \leqq 90$, respectively.

The polymer of the invention is also preferably a polymer having a partial structure represented by the following formula (4):

Formula (4)

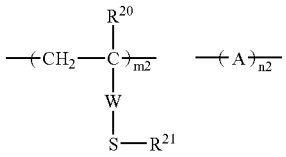

In the formula (4), $R^{20}$ represents a hydrogen atom or methyl group. $R^{21}$ represents an alkyl group or an aryl group. W represents a divalent linking group. A represents a unit having an ethylenically unsaturated group. m2 and n2 represent percentages by mole of repeating units in the polymer and satisfy relationships of $50 \leqq m^2 \leqq 95$ and $5 \leqq n^2 \leqq 50$.

In formula (4), $R^{21}$ represents an alkyl group or an aryl group.

The alkyl group represented by $R^{21}$ is preferably an alkyl group having 1 to 18 carbon atoms, more preferably 1 to 12. Specific examples of the alkyl group include a methyl group, an ethyl group, a n-propyl group, an isopropyl group, a n-butyl group, a t-butyl group, a n-hexyl group, a cyclohexyl group, a n-octyl group, a 2-ethylhexyl group, a decyl group and a dodecyl group. These alkyl groups may further have a substituent (for example a hydroxyl group, a carboxyl group, a sulfo group, an alkyloxycarbonyl group, a carbamoyl group, a sulfamoyl group, a cyano group, an amino group, an alkoxy group and a phenyl group), an ester bond, an ether bond and an amide bond.

The aryl group represented by $R^{21}$ is preferably an aryl group having 6 to 12 carbon atoms. Specific examples of them include a phenyl group and a naphthyl group, and these aryl groups may further have a substituent.

$R^{21}$ is preferably an alkyl group substituted with a hydrophilic group, more preferably an alkyl group substituted with a hydrophilic group having 1 to 8 carbon atoms. Specific examples thereof include a hydroxyethyl group, a 2,3-dihydroxypropyl group, a 2-carboxyethyl group, a 3-carboxypropyl group, a 3-sulfoxypropyl group, a 2-aminoethyl group, a N,N-diaminoethyl group and a triethylammonium ethyl group.

In the formula (4), W represents a divalent linking group. Examples of the divalent linking group represented by W include an alkylene group (for example a methylene group, an ethylene group, a trimethylene group, a tetramethylene group, a hexamethylene group, a cyclohexylene group and a 2-hydroxypropylene group), an arylene group (for example a phenylene group), a (thio)ether bond, a (thio)ester bond and amide bond, and a linking group comprising a combination of a plurality of them.

In the formula (4), A represents a unit having an ethylenically unsaturated group. Examples of such unit include aryl acrylate, aryl methacrylate, 1,2-butadiene, 1,4-butadiene and isoprene, and 1,2-butadiene, 1,4-butadiene and isoprene are preferable among them.

In the formula (4), $m^2$ and $n^2$ represent percentages by mole of repeating units in the polymer and satisfy relationships of $50 \leqq m^2 \leqq 95$ and $5 \leqq n^2 \leqq 50$, respectively, preferably $70 \leqq m^2 \leqq 95$ and $5 \leqq n^2 \leqq 30$, respectively. The color fading due to ozone gas in air is remarkably prevented when $m^2$ and $n^2$ are in the range of $50 \leqq m^2 \leqq 95$ and $5 \leqq n^2 \leqq 50$, respectively.

Preferably, the polymer of the invention is water-soluble or has a spontaneous emulsifying property. The water-soluble polymer as used in the invention refers to a polymer having a solubility of 0.1% by mass or more, preferably 0.5% by mass or more, and more preferably 1% by mass or more in water at a room temperature of 25° C.

Alternatively, the polymer having a spontaneous emulsifying property as used in the invention refers to a polymer exhibiting stable dispersibility at a concentration of 0.5% by mass or more, preferably 1% by mass or more, and more preferably 3% by mass or more at a room temperature of 25° C.

The mass average molecular weight of the polymer of the invention is preferably 1,000 to 1,000,000, more preferably 2,000 to 100,000.

Water resistance and prevention of bleeding over time as well as handling ability are improved when the mass average molecular weight is in the range of 1,000 to 1,000,000.

Examples of the synthesis method of the polymer of the invention include a polymerization condensation, addition polymerization, polyaddition, addition condensation or ring-opening polymerization methods, or a synthesis method by polymer reactions. The polymer of the invention is preferably obtained by addition reaction, and preferable examples include a polymer obtained by addition polymerization (for example radical polymerization of vinyl monomers having thioether bonds, or polymerization of vinyl monomers using a mercapto compound as a chain transfer agent), and by a polymer reaction (for example nucleophilic addition reaction to polymer side chains having reactive groups, or radical addition reaction).

It is particularly preferable that the polymer of the invention is derived from a polybutadiene polymer or polyisoprene polymer. The method for obtaining the polymer of the invention as a derivative of the polybutadiene or polyisoprene polymer include radical addition by which radicals of one or at least two mercapto compounds are added to the polybutadiene or polyisoprene polymer. When the polymer of the invention has a partial structure represented by the formula (3), radicals of a cationic mercapto compound and at least one of other mercapto compounds are added to the polybutadiene or polyisoprene polymer.

Examples of the mercapto compound include 2-aminoethanethiol hydrochloride, 2-aminoethanethiol-p-toluenesulfonate, N,N-dimethylaminoethanethiol hydrochloride, N,N-diethylaminoethanethiol hydrochloride, 2-mercaptoethyl trimethyl ammonium chloride, N,N-dimethylaminoethanethiol methane sulfonate and N,N-dimethylaminoethanethiol acetate as the cationic mercapto compound; and 2-mercaptoethanol, 3-mercaptopropanol, α-thioglycerol, thioglycolic acid, 3-mercaptopropionic acid, 2-mercaptopropionic acid, ethyl 3-mrcaptopropionate, hexyl 3-mrcaptopropionate, octyl 3-mrcaptopropionate, ethyl mercaptan, t-butyl mercaptan, n-dodecyl mercaptan, benzyl mercaptan, 4-mercaptophenol, 4-mercaptotoluene, cysteine, and 3-mercaptopropane sulfonic acid as other mercapto compounds.

When the polymer of the invention has a partial structure represented by the formulae (3) or (4), the polymer may further contains a vinyl monomer capable of polymerizing with the partial structure represented by the formulae (3) and (4).

Specific examples of the vinyl monomer include the following compounds:

alkyl (meth)acrylate (for example alkyl esters having 1 to 18 carbon atoms of (meth)acrylate such as methyl (meth) acrylate, ethyl (meth)acrylate, propyl (meth)acrylate, isopropyl (meth)acrylate, n-butyl (meth)acrylate, isobutyl (meth) acrylate, t-butyl (meth)acrylate, hexyl (meth)acrylate, octyl (meth)acrylate, 2-ethylhexyl (meth)acrylate, lauryl (meth) acrylate and stearyl (meth)acrylate); cycloalkyl (meth)acrylate (for example cyclohexyl (meth)acrylate); aryl (meth) acrylate (for example phenyl (meth)acrylate); aralkyl (meth) acrylate (for example benzyl (meth)acrylate); substitute alkyl (meth)acrylate (for example hydroxyethyl (meth)acrylate); (meth)acrylamide (for example (meth)acrylamide and dimethyl (meth)acrylamide); aromatic vinyl (for example styrene, vinyl toluene and α-methyl styrene); vinyl ester (for example vinyl acetate, vinyl propionate and vinyl versatate); aryl ester (for example aryl acetate); halogen-containing monomers (for example vinylidene chloride and vinyl chloride); cyanided vinyl (for example (meth)acrylonitrile); and olefin (for example ethylene and propylene). The polymer of the invention may contain one or at least two vinyl monomers.

While preferable examples of the polymer of the invention (P-1 to P-34) are shown below, the invention is by no means restricted to these examples.

P-1
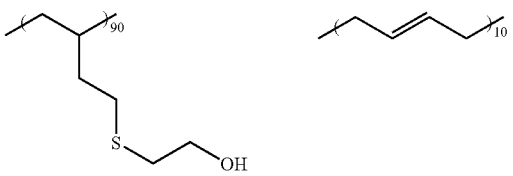
(S equivalent: 7.23 meq/g, I/O value: 0.94)
P-2
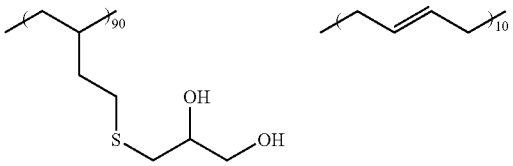
(S equivalent: 5.94 meq/g, I/O value: 1.42)
P-3
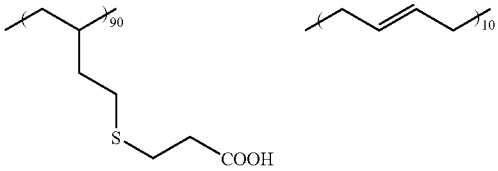
(S equivalent: 6.56 meq/g, I/O value: 0.98)
P-4
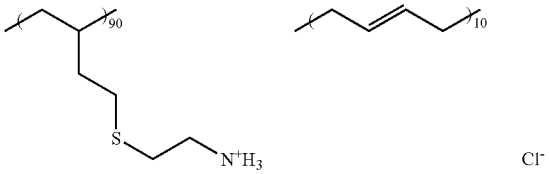
(S equivalent: 7.18 meq/g, I/O value: 2.96)
P-5
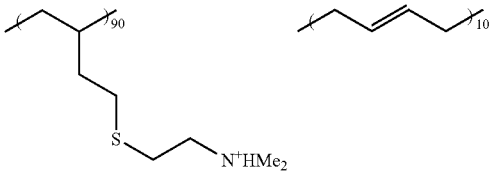
(S equivalent: 4.96 meq/g, I/O value: 2.33)
P-6
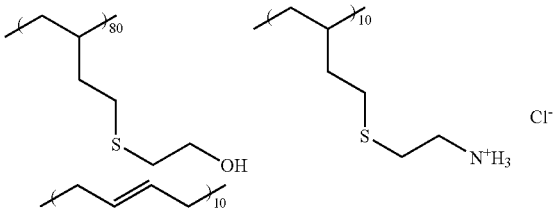
(S equivalent: 7.18 meq/g, I/O value: 1.17)
P-7
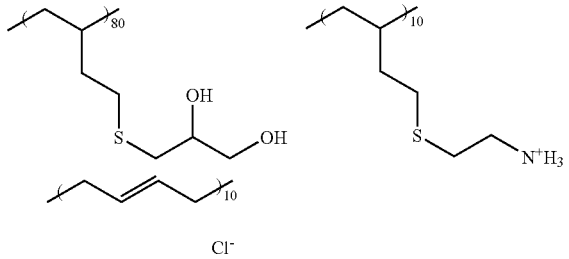
(S equivalent: 5.47 meq/g, I/O value: 1.74)
P-8
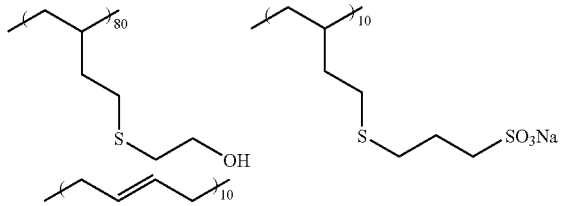
(S equivalent: 6.70 meq/g, I/O value: 1.41)
P-9
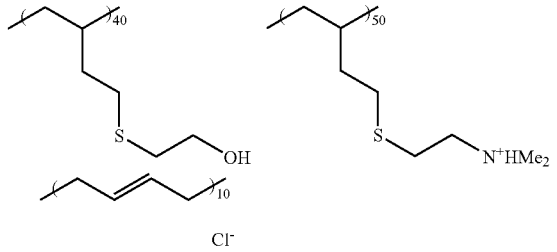
(S equivalent: 5.76 meq/g, I/O value: 1.79)

P-10
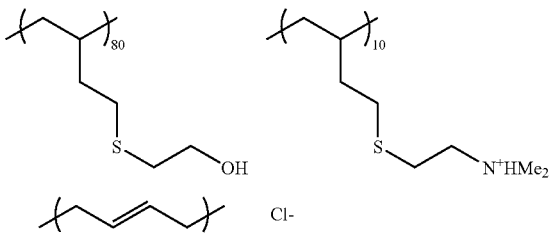
(S equivalent: 6.88 meq/g, I/O value: 1.13)
P-11
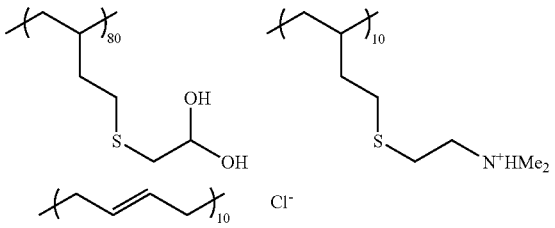
(S equivalent: 5.82 meq/g, I/O value: 1.53)
P-12
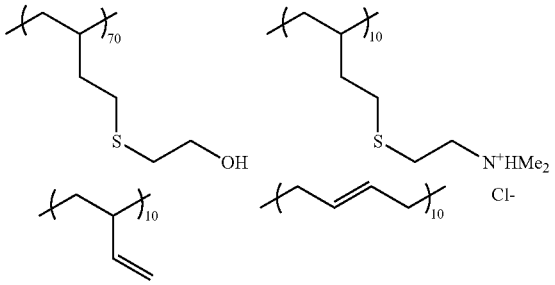
(S equivalent: 6.51 meq/g, I/O value: 1.08)
P-13
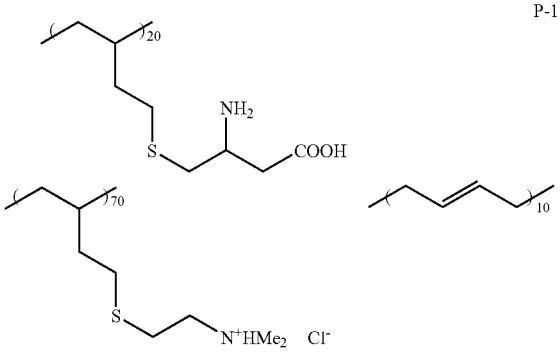
(S equivalent: 5.07 meq/g, I/O value: 2.99)
P-14
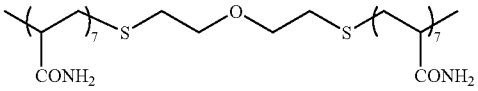
(S equivalent: 1.76 meq/g, I/O value: 2.81)
P-15
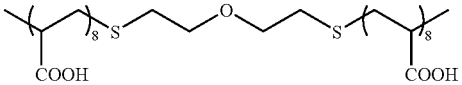
(S equivalent: 1.55 meq/g, I/O value: 2.33)
P-16
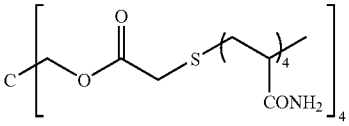
(S equivalent: 2.55 meq/g, I/O value: 2.76)
P-17
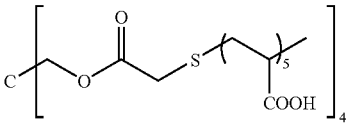
(S equivalent: 2.13 meq/g, I/O value: 2.21)
P-18
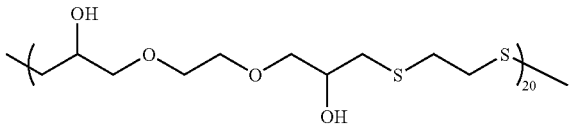
(S equivalent: 7.45 meq/g, I/O value: 1.57)
P-19
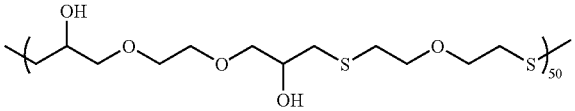
(S equivalent: 6.40 meq/g, I/O value: 1.41)

P-20
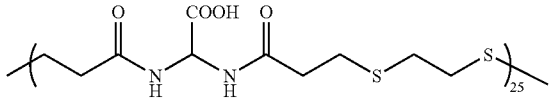
(S equivalent: 6.84 meq/g, I/O value: 2.62)
P-21
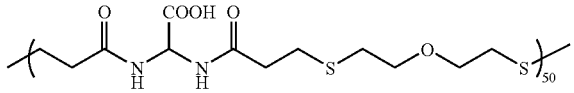
(S equivalent: 536 meq/g, I/O value:2.32)
P-22
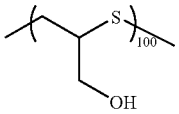
(S equivalent: 11.1 meq/g, I/O value: 1.75)
P-23
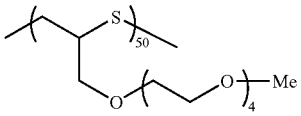
(S equivalent: 3.56 meq/g, I/O value: 1.37)
P-24
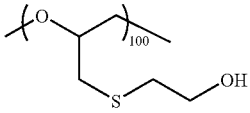
(S equivalent: 7.45 meq/g, I/O value: 1.33)
P-25
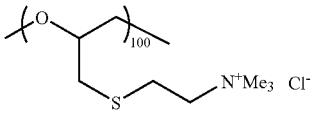
(S equivalent:4.72 meq/g, I/O value: 2.56)
P-26
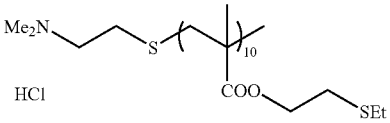
(S equivalent: 5.04 meq/g, I/O value: 0.76)
P-27
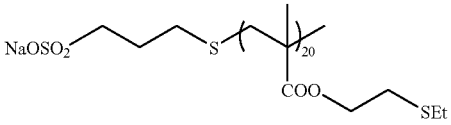
(S equivalent: 4.92 meq/g, I/O value: 0.76)
P-28
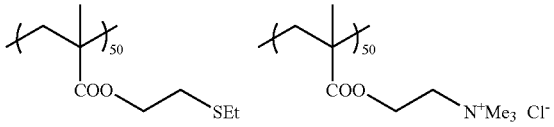
(S equivalent: 2.26 meq/g, I/O value: 1.56)
P-29
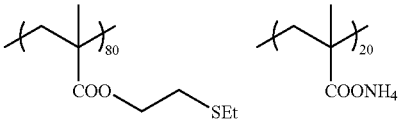
(S equivalent: 4.21 meq/g, I/O value: 0.89)
P-30
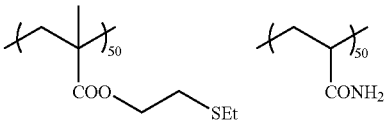
(S equivalent: 3.63 meq/g, I/O value: 1.25)

P-31

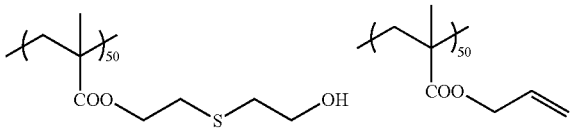

(S equivalent: 3.16 meq/g, I/O value: 0.82)

P-32

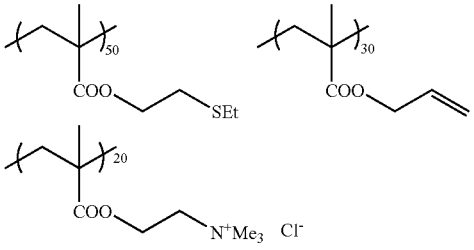

(S equivalent: 3.00 meq/g, I/O value: 0.96)

P33

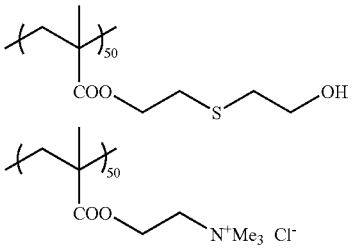

(S equivalent: 2.51 meq/g, I/O value: 1.83)

P-34

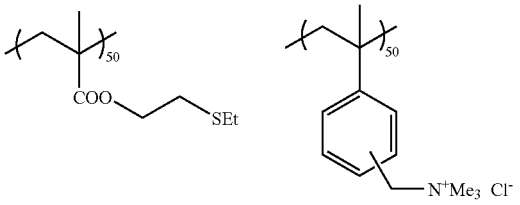

(S equivalent: 2.59 meq/g, I/O value: 1.21)

The content of the polymer of the invention is preferably 0.01 to 10 g/m$^2$, particularly 0.05 to 5 g/m$^2$ in the ink receiving layer.

(Fine Particles)

The ink receiving layer of the ink jet recording medium of the invention preferably contains fine particles.

The ink receiving layer of the ink jet recording medium acquires a porous structure by containing the fine particles to thereby improve ink absorbing performance. In particular, the solid contents exceeding 50% by mass, more preferably 60% by mass, in the ink receiving layer of the fine particles is preferable, since an ink jet recording medium having a sufficient ink absorbing property is obtained by enabling a better porous structure to be formed. The solid contents in the ink receiving layer of the fine particles is calculated herein based on the components in the composition constituting the ink receiving layer except water.

While the fine particles used in the invention are preferably inorganic fine particles, organic fine particles may be used so long as the particles do not impair the effect of the invention.

Preferable organic fine particles include polymer fine particles obtained by emulsion polymerization, micro-emulsion polymerization, soap-free polymerization, seed polymerization, dispersion polymerization and suspension polymerization, for example polymer fine particles such as powder, latex and emulsion of polyethylene, polypropylene, polystyrene, polyacrylate, polyamide, silicon resin, phenol resin and natural polymer.

Examples of the inorganic fine particles include silica fine particles, colloidal silica, titanium dioxide, barium sulfate, calcium silicate, zeolite, kaolinite, halloysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide, and yttrium oxide. Silica fine particles, colloidal silica, alumina fine particles and pseudo-boehmite is preferable among them from the viewpoint of forming a good porous structure. The fine particles may be used as primary particles, or after forming secondary particles. The average primary particle diameter of these fine particles is preferably 2 μm or less, more preferably 200 nm or less.

Furthermore, silica fine particles with an average primary particle diameter of 20 nm or less, colloidal silica with an average primary particle diameter of 30 nm or less, alumina fine particles with an average primary particle diameter of 20 nm or less, and pseudo-boehmite with an average fine pore diameter of 2 to 15 nm are more preferable, and the silica fine particles, alumina fine particles and pseudo-boehmite are particularly preferable.

The silica fine particles are roughly classified into wet method particles and dry method (gas phase method) particles depending on their production method. In the prevailing wet method, active silica is formed by acidolysis of a silicate salt, and active silica is appropriately polymerized to obtain hydrated silica by coagulation and precipitation. In contrast, anhydrous silica is obtained by hydrolysis of silicon halide in a gas phase at a high temperature (flame hydrolysis method), or silica sand and coke are vaporized by reduction by heating with arc in an electric furnace, and the product thereof is oxidized with air (arc method) in the prevailing gas phase method. The "gas phase silica" means anhydrous silica fine particles obtained by the gas phase method. The silica fine particles by the gas phase method are particularly preferable as the silica fine particles used in the invention.

Although the gas phase silica exhibits different properties from hydrated silica due to the difference of the density of the silanol groups on the surface and the proportion of the voids, the gas phase silica is suitable for forming a three-dimensional structure having a high void ratio. While the reason thereof is not clear, the density of the silanol groups on the surface of the fine particles is as large as 5 to 8 pieces/nm$^2$ in hydrated silica to make the silica particles to be readily aggregated. In contrast, the density of the silanol group on the surface of the fine particles is supposed to be as small as 2 to 3 groups/nm$^2$ in gas phase silica to form coarse and soft flocculates, thereby forming a structure having a high void ratio.

Since gas phase silica has a particularly large surface area, the efficiency for absorbing and retaining an ink becomes high. In addition, the ink receiving layer becomes transparent by dispersing the particles having a proper particle diameter since the refractive index of gas phase silica is low, thereby exhibiting characteristics for enabling a high color density and good coloring property to be obtained. It is important for obtaining a high color density and good glossiness of colors that the color receiving layer is transparent not only in the uses requiring high transparency such as an OHP film, but also in an application as a recording sheet such as a photographic glossy paper sheet.

The average primary particle diameter of gas phase silica is preferably 30 nm or less, more preferably 20 nm or less, particularly 10 nm or less, and most preferably 3 to 10 nm. Since the gas phase silica particles are liable to be coagulated with each other due to the hydrogen bond between the silanol groups, a structure having a large void ratio may be formed when the average primary particle diameter is 30 nm or less, and ink absorbing characteristics may be effectively improved.

The silica fine particles may be used together with other fine particles. The content of gas phase silica is preferably 30% by mass or more, more preferably 50% by mass or more, when the gas phase silica particles are used together with other fine particles.

Alumina fine particles, alumina hydrate, and a mixture or composite thereof are also preferable as the inorganic fine particles used in the invention. The alumina hydrate is preferable among them since it is able to favorably fix the ink by absorbing the ink, and pseudo-boehmite ($Al_2O_3.nH_2O$) is particularly preferable. While various forms of the alumina hydrate may be used, boehmite sol is preferably used as the material since a smooth surface can be readily obtained.

The fine void structure of pseudo-boehmite has an average fine void diameter of preferably 1 to 30 nm, more preferably 2 to 15 nm. The fine void volume is preferably 0.3 to 2.0 cc/g, more preferably 0.5 to 1.5 cc/g. The fine void diameter and fine void volume are measured by a nitrogen absorption-desorption method using, for example, a gas absorption-desorption analyzer (for example, Omnisorp 369 manufactured by Beckman Coulter, Inc.).

The gas phase alumina fine particles are preferable among the alumna fine particles due to a large surface area. The average primary particle diameter of gas phase alumina is preferably 30 nm or less, more preferably 20 nm or less.

The embodiments disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314 can be also preferably used when the fine above-mentioned particles are used in for the ink jet recording medium.

(Water Soluble Resin)

It is preferable that the ink jet recording medium of the invention further contains a water soluble resin in the ink receiving layer.

Examples of the water soluble resin include polyvinyl alcohol resins having hydroxyl groups as a hydrophilic structural unit (for example polyvinyl alcohol (PVA), acetoacetyl-modified polyvinyl alcohol, cation-modified polyvinyl alcohol, anion-modified polyvinyl alcohol, silanol-modified polyvinyl alcohol and polyvinyl acetal), cellulose resins (methyl cellulose (MC), ethyl cellulose (EC), hydroxyethyl cellulose (HEC), carboxymethyl cellulose (CMC), hydroxypropyl cellulose (HPC), hydroxyethylmethyl cellulose and hydroxypropylmethyl cellulose), chitin, chitosan, starch, resins having ether bonds (polyethylene oxide (PEO), polypropylene oxide (PPO), polyethyleneglycol (PEG) and polyvinyl ether (PVE)), resins having carbamoyl groups (polyacrylamide (PAAM), polyvinyl pyrrolidone (PVP) and polyacrylic acid hydrazide).

The other examples include polyacrylic acid salts, maleic acid resins, alginic acid salts and gelatin having carboxylic groups as dissociation groups.

The polyvinyl alcohol resins are particularly preferable among the resin above. Examples of the polyvinyl alcohol resins are described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345 and 8-324105, 11-348417.

Examples of the water soluble resin other than the polyvinyl alcohol resins are the compounds described in paragraph Nos. 0011 to 0014 in JP-A No. 11-165461.

The water soluble resins may be used alone, or as a combination of two or more of them.

The content of the water soluble resin of the invention is preferably 9 to 40% by mass, more preferably 12 to 33% by mass, relative to the mass of total solid fraction of the ink receiving layer.

The water soluble resin and fine particles mainly constituting the ink receiving layer of the invention may comprise respective single materials, or a mixed material of a plurality of materials.

The kind of the water soluble resin combined with fine particles, particularly silica fine particles, is important from the viewpoint of maintaining transparency. Polyvinyl alcohol resins are preferable as the water soluble resin when gas phase silica is used. The polyvinyl alcohol resin with a degree of saponification of 70 to 100% is more preferable, and the polyvinyl alcohol resin with a degree of saponification of 80 to 99.5% is particularly preferable.

While the polyvinyl alcohol resin has hydroxyl groups in its structural unit, a three dimensional network structure is readily formed using secondary particles of the silica fine particles as a network chain unit, since the hydroxyl group forms hydrogen bonds with the silanol group on the surface of the silica fine particles. The ink receiving layer having a porous structure with a high void ratio and sufficient strength is considered to be formed by forming the three dimensional network structure.

The porous ink receiving layer obtained as described above rapidly absorb the ink by capillary action during the ink jet recording process, and can form high circularity of dots without causing bleeding of the ink.

The polyvinyl alcohol resin may be used together with other water soluble resins. The content of the polyvinyl alcohol resin in the total water soluble resins is preferably 50% by mass or more, more preferably 70% by mass or more, when the polyvinyl alcohol resin is used together with other water soluble resins.

<Composition Ratio of Fine Particles and Water Soluble Resin>

The mass composition ratio (PB ratio (x/y)) between the proportion fine particles (x) and water soluble resin (y) largely affect the structure and strength of the ink receiving layer. While the void ratio, fine void volume and surface area (per unit mass) tend to increase as the mass composition ratio (PB ratio) increases, the density and strength tends to be decreased.

The mass composition ratio (PB ratio, (x/y)) of the ink receiving layer of the invention is preferably 1.5 to 10, for preventing decrease of the layer strength and cracks from generating by drying due to too large PB ratio, and for preventing decrease of ink absorbing ability due to blocking of voids with the resin and decrease of the void ratio when the PB ratio is too small.

Since a strain may be applied on a recording sheet when the recording sheet is conveyed in a conveyer system of an ink jet printer, the ink receiving layer should have sufficient film strength. The ink receiving layer should also have a sufficient strength for preventing cracks and peeling of the ink receiving layer from being generated when the recording sheet is cutting into smaller sheets. The mass ratio (x/y) of 5 or less is more preferable considering the cases above, and a mass ratio of 2 or more is more preferable from the viewpoint of ensuring high speed ink absorption in the ink jet printer.

The three dimensional network structure comprising the network chains of the secondary particles of the silica fine particles is formed, for example, by preparing a coating liquid in which the gas phase silica fine particles with an average primary diameter of 20 nm or less and water soluble resin are completely dispersed in water in a mass ratio (x/y) of 2 to 5, by applying the coating liquid on the substrate, and by drying the coated layer. A light-permeable porous layer with an average fine void diameter of 30 nm or less, a void ratio of 50 to 80%, a specific void volume of 0.5 ml/g or more, and a specific surface area of 100 $m^2/g$ or more may be readily formed by the procedure above.

(Cross-Linking Agent)

In one embodiment of the ink receiving layer of the ink jet recording medium of the invention, it is preferable that a coated layer containing the fine particles and the water soluble resin further contains a cross-linking agent capable of cross-linking the water soluble resin, and that the ink receiving layer is a porous layer obtained by hardening the coated layer by a cross-linking reaction between the fine particles and the cross-linking agent.

Boron compounds are preferably used for cross-linking of the water soluble resin, particularly polyvinyl alcohol resin. Examples of the boron compound include borax, boric acid, borate (for example orthoborate, $InBO_3$, $ScBO_3$, $YBO_3$, $LaBO_3$, $Mg_3(BO_3)_2$ and $Co_3(BO_3)_2$), diborate (for example $Mg_2B_2O_5$, $Co_2B_2O_5$), methaborate (for example $LiBO_2$, $Ca(BO_2)_2$, $NaBO_2$ and $KBO_2$), tetraborate (for example $Na_2B_4O_7.10H_2O$), and pentaborate (for example $KB_5O_8.4H_2O$, $Ca_2B_6O_{11}.7H_2O$, and $CsB_5O_5$). Borax, boric acid and borates are preferable for permitting the cross-linking reaction to be promptly induced, and boric acid is particularly preferable.

The following compounds other than the boron compounds may be used as the cross-linking agent of the water soluble resin.

The compounds are, for example, aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine, 2,4-dichloro-6-triazine sodium salt; active vinyl compounds such as divinyl sulfonic acid, 1,3-divinylsulfonyl-2-propanol, N,N'-ethylenebis(vinylsulfonylacetamide), and 1,3,5-triaclyroyl-hexahydro-S-triazine; N-methylol compounds such as dimethylol urea, and methylol dimethylhydantoin; melamine resins (for example methylolmelamine, alkylated methylolmelamine; and epoxy resins.

Examples of the preferable cross-linking agent include isocyanate compounds such as 1,6-hexamethylene diisocyanate; aziridine compounds described in U.S. Pat. Nos. 3,017,280 and 2,983,611; carboxyimide compounds described in U.S. Pat. No. 3,100,704; epoxy compounds such as glycerol triglycidyl ether; ethylene imino compounds such as 1,6-hexamethylene-N,N'-bisethylene urea; halogenated carboxyaldehyde compounds such as mucochloric acid and mucophenoxy chloric acid; dioxane compounds such as 2,3-dihydroxydioxane, metal-containing compounds such as titanium lactate, aluminum sulfate, chromium alum, potassium alum, zirconium acetate and chromium acetate; polyamine compounds such as tetraethylenepentamine; hydrazide compounds such as hydrazine adipate; and low molecular weight compounds or polymers containing at least two oxazoline groups.

The above mentioned cross-linking agents may be used alone, or as a combination thereof.

Preferably, the coated layer is cross-linked and hardened by adding the cross-linking agent to at least one of a coating liquid containing the fine particles, the water soluble resin and the like (sometimes referred to as "coating liquid A" hereinafter), and a basic solution having a pH value of greater than 7, and by applying the basic solution (sometimes referred to as "coating liquid B" hereinafter) to the coated layer (1) at substantially the same time that the coated layer is formed by applying the coating liquid, or (2) during drying of the coated layer formed by applying the coating liquid, and before the coated layer exhibits a decreasing rate of drying. The cross-linking agent is preferably applied as follows in the example of the boron compounds. When the ink receiving layer is prepared by cross-linking and hardening the coated layer obtained by applying the coating liquid containing a water soluble resin containing the fine particles and polyvinyl alcohol (coating liquid A), the coated layer is cross-linked and hardened by applying the basic solution (coating liquid B) having a pH value greater than 7 either (1) at substantially the same time that the coated layer is formed by applying the coating liquid, or (2) during drying of the coated layer formed by applying the coating liquid and before the coated layer exhibits a decreasing rate of drying. The boron compound serving as the cross-linking agent may be contained in either the coating liquid A or the coating liquid B, or in both the coating liquid A and the coating liquid B.

The amount of use of the cross-linking solution is preferably 1 to 50% by mass, more preferably 5 to 40% by mass, to the amount of the water soluble resin.

(Mordant)

A mordant is preferably contained in the ink receiving layer for further improving water resistance and reducing bleeding over time of the image formed.

Such mordant is preferably a cationic polymer (cationic mordant) as an organic mordant, or an inorganic mordant. Presence of the mordant in the ink receiving layer permits colorant to be stabilized by an interaction between the mordant and a liquid ink containing an anionic dye as the colorant thereby permitting water resistance to be improved and bleeding over time to be reduced. Each of organic mordant and the inorganic mordant may be used alone, or may be used together.

Polymer mordants having primary to tertiary amino groups, or quaternary ammonium group as cationic groups are usually used as the cationic mordants. However, cationic non-polymer mordants may be also used in the invention.

Examples of the polymer mordant include homopolymers of monomers (mordant monomers) comprising the primary to tertiary amino groups and salts thereof or quaternary ammonium salts, and copolymers or condensed polymers between the dye mordant monomer and other monomers (referred to as "non-mordant monomer" hereinafter). These polymer mordants may be used either as water soluble polymers or water dispersible latex particles.

Examples of the monomer (mordant monomer) include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl) benzyl-N-p-vinylbenzyl ammonium chloride, and N,N-dimethyl-N-phenyl-N-p-vinylbenzyl ammonium chloride;

trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, and N,N-diethyl-N-methyl-N-2-(4-vinylphenyl)ethyl ammonium acetate; and N,N-dimethylaminoethyl (meth)acrylate, N,N-diethylaminoethyl (meth)acrylate, N,N-dimethylaminopropyl (meth)acrylate, N,N-diethylaminopropyl (meth)acrylamide, N,N-dimethylaminoethyl (meth)acrylamide, N,N-diethylaminoethyl (meth)acrylamide, N,N-dimethylaminopropyl (meth)acrylamide, N,N-diethylaminopropyl (meth)acrylamide, and salts thereof (for example hydrochloride, nitrate, acetate, lactate, methanesulfonate and p-toluenesulfonate);

trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, trimethyl-3-(acryloylamino)propylammonium chloride, triethyl-3-(acryloylamino)propylammonium chloride;

N,N-dimethyl-N-ethyl-2-(methacryloyloxy)ethylammonium chloride, N,N-diethyl-N-methyl-2-(methacryloyloxy) ethylammonium chloride, N,N-dimethyl-N-ethyl-3-(acryloylamino)propylammonium chloride, trimethyl-2-(methacryloyloxy)ethylammonium bromide, trimethyl-3-(acryloylamino)propylammonium bromide, trimethyl-2-(methacryloyloxy)ethylammonium sulfonate, and trimethyl-3-(acryloylamino)propylammonium acetate.

Examples of other mordant monomer include N-vinylimidazole, N-vinyl-2-methylimidazole, 2-vinylpyridine, 4-vinylpyridine, 4-vinyl-N-methylpyridinium chloride, 4-vinyl-N-ethylpyridinium bromide, dimethyldiallylammonium chloride, and monomethyldiallylammonium chloride.

The mordant monomer may be used alone, or as a combination of copolymerizable two or more of them.

The non-mordant monomers refer to those that contain no basic or cationic portions such as primary to tertiary amino groups or quaternary ammonium salts, and that do not interact, or exhibit substantially small interaction, with dyes in an ink-jet ink.

Examples of the non-mordant monomer include alkyl (meth)acrylate (for example C1-18 alkyl (meth)acrylate such as methyl (meth)acrylate, ethyl (meth)acrylate, propyl(meth) acrylate, isopropyl (meth)acrylate, n-butyl (meth)acrylate, isobutyl (meth)acrylate, t-butyl (meth)acrylate, hexyl (meth) acrylate, octyl (meth)acrylate, 2-ethylhexyl (meth)acrylate, lauryl (meth)acrylate and stearyl (meth)acrylate); cycloalkyl (meth)acrylate (such as cyclohexyl (meth)acrylate); aryl methacrylate (such as phenyl (meth)acrylate)); aralkyl (meth) acrylate (such as benzyl(meth)acrylate); substituted alkyl (meth)acrylate (such as 2-hydroxyethyl (meth)acrylate, methoxymethyl (meth)acrylate and allyl (meth)acrylate); (meth)acrylamides (such as (meth)acrylamide, dimethyl (meth)acrylamide, N-ethyl (meth)acrylamide, and N-isopropyl (meth)acrylamide); aromatic vinyl (styrene, vinyltoluene and a-methylstyrene); vinyl esters (such as vinyl acetate, vinyl propionate and vinyl versatate); allyl esters (such as allyl acetate); halogen-containing monomers (such as vinylidene chloride and vinyl chloride); vinyl cyanate (such as (meth)acrylonitrile); and olefins (such as ethylene and propylene).

These non-mordant monomers may be used alone, or as a combination of two or more of them.

Examples of the polymer mordant include polyethyleneimine (and derivatives thereof), polyvinylamine (and derivatives thereof), polyallyamine (and derivatives thereof), polyamidine, cationic polysaccharide (such as cationic starch and chitosan), dicyan cationic resin (such as dicyan diamide-formalin polymerization condensation products), polyamine cationic resin (such as dicyan diamide-diethylenetriamine polymerization condensation products), epichlorohydrin-dimethylamine addition polymers, and dimethyldiallylammonium chloride-sulfur dioxide copolymer.

Polymers having quaternary ammonium base are preferable, and (meth)acrylate polymers, vinylbenzylammonium polymers and diallylammonium polymers having weight average molecular weight of 1,000 to 100,000 and quaternary ammonium base are particularly preferable as the organic mordant of the invention.

Inorganic mordants may be used as the dye mordant of the invention, and examples thereof include salts of polyfunctional water soluble metals and hydrophobic metal chlorides.

Examples of the inorganic mordant include salts or complexes of the metals selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten and bismuth.

Specific examples include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, copper (II) chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidesulfate tetrahydrate, aluminum sulfate, aluminum alum, basic polyhydroxy aluminum, aluminum sulfite, aluminum thiosulfate, aluminum polychloride, aluminum nitrate nanohydrate, aluminum chloride hexahydrate, iron (I) bromide, iron (I) chloride, iron (II) chloride, iron (I) sulfate, iron (II) sulfate, zinc phenolsulfonate, zinc bromide, zinc chloride, zinc nitrate hexahydrate, zinc sulfate, titanium tetrachloride, tetraisopropyl titanate, titanium acetylacetonate, titanium lactate, zirconium acetylacetonate, zirconium acetate, zirconium sulfate, zirconium ammonium carbonate, zirconyl stearate, zirconyl octylate, zirconyl nitrate, zirconium oxychloride, zirconium hydroxychloride, chromium acetate, chromium sulfate, magnesium sulfate, magnesium sulfate hexahydrate, magnesium citrate nanohydrate, sodium phosphotungstate, sodium tungsten citrate, 12-tungstophosphate n-hydrate, 12-tungustosilisic acid 26 hydrate, molybdenum chloride, 12-molybdophosphate n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

The inorganic mordants of the invention are preferably water-soluble polyvalent metal salts, more preferably aluminum-containing compounds, titanium-containing compounds and zirconium-containing compounds, particularly basic polyhydroxyl aluminum, poly-aluminum chloride, aluminum acetate, aluminum lactate, titanium lactate, zirconium acetate, ammonium zirconium carbonate and zirconium oxychloride.

The content of the mordant in the ink receiving layer is preferably 0.01 to 10 g/m$^2$, more preferably 0.1 to 5 g$^2$.

The ink receiving layer coating liquid (coating liquid A) preferably contains a surfactant. Any surfactants such as cationic, anionic, nonionic, amphoteric, fluorine and silicone surfactants are available.

Examples of the preferable nonionic surfactant include polyoxyalkylene alkylether and polyoxyalkylene alkylphenylether (such as diethyleneglycol monoethylether, diethyleneglycol diethylether, polyoxyethylene laurylether, polyoxyethylene stearylether and polyoxyethylene nonylphenylether); oxyethylene-oxypropylene block copolymer, sorbitan fatty acid esters (such as sorbitan monolaurate, sorbitan monooleate and sorbitan trioleate); polyoxyethylene sorbitan fatty acid esters (such as polyoxyethylene sorbitan monolaurate, polyoxyethylene sorbitan monoolelate and polyoxyethylene sorbitan trioleate); polyoxyethylene sorbitol fatty acid esters (such as tetra oleic acid polyoxyethylene sorbit); glycerin fatty acid esters (such as glycerol monooleate); polyoxyethylene glycerin fatty acid esters (such as monostearic acid polyoxyethylene glycerin and monooleic acid polyoxyethylene glycerin); polyoxyethylene fatty acid esters (such as polyethyleneglycol monolaurate, and polyethyleneglycol monooleate); polyoxyethylene alkylamine; and acetylene glycols (such as 2,4,9,7-tetramethyl-5-decyn-4,7-diol, and ethylene oxide adducts and propylene oxide adducts of the diol). Polyoxyalkylene alkylethers are preferable among them. The nonionic surfactant may be used in both solution A and solution B. The nonionic surfactants may be used alone, or as a combination of two or more of them.

Examples of the amphoteric surfactants include those of amino acid type, carboxyamonium betaine type, sulfoammonium betaine type, ammonium sulfonic ester betaine type and imidazolium betaine type, and those described in U.S. Pat. No. 3,843,368, JP-A Nos. 59-49535, 63-236546, 5-303205, 8-262742 and 10-282619 may be favorably used. Amphoteric surfactants of the amino acid type are preferable as the amphoteric surfactant, which are derived from amino acids (such as glycine, glutamic acid and histidine) as described in JP-A No. 5-303205. An example thereof is N-aminoacyl acid in which a long chain acyl group is introduced and the salt thereof. The amphoteric surfactants may be used alone, or as a combination of at least two of them.

Examples of the anionic surfactants include fatty acid salts (for example sodium stearate and potassium oleate), salts of alkylsulfuric acid ester (for example sodium lauryl sulfate and triethanolamine lauryl sulfate), sulfonic acid slats (for example sodium dodecylbenzene sulfonate), alkylsulfosuccinic acid salts (for example sodium dioctylsulfosuccinate), alkyldiphenylether disulfonic acid salts, and alkylphosphoric acid salts.

Examples of the cationic surfactants include alkylamine salts, quaternary ammonium salts, pyridinium salts and imidazolium salts.

Examples of the fluorine containing surfactants include a compound derived via an intermediate having perfluoroalkyl groups using any one of electrolytic fluorination, teromerization and origomerization methods.

Examples of the fluorine containing surfactants include perfluoroalkyl sulfonic acid salts, perfluoroalkyl carboxylic acid salts, perfluoroalkyl ethylene oxide adducts, perfluoroalkyl trialkyl ammonium salts, perfluoroalkyl group containing oligomers, and perfluoroalkyl phosphoric acid esters.

The silicon surfactant is preferably a silicone oil modified with an organic group, which may have a structure comprising side chains of a siloxane structure modified with the organic group, a structure having modified both terminals, and a structure having a modified terminal. Examples of modification with the organic group include amino modification, polyether modification, epoxy modification, carboxyl modification, carbinol modification, alkyl modification, aralkyl modification, phenol modification and fluorine modification.

The content of the surfactant of the invention is preferably 0.01 to 2.0%, more preferably 0.01 to 1.0%, relative to the coating liquid (coating liquid A) for the ink receiving layer. When at least two coating liquids for the ink receiving layer are used for coating, it is preferable to add the surfactant to respective coating liquids.

The ink receiving layer of the invention preferably contains a high boiling point organic solvent for preventing curling. The high boiling point organic solvent is an organic compound having a boiling point of 150° C. or more at an atmospheric pressure, and a water soluble or hydrophobic compound. These solvent may be a solid or liquid at room temperature, and may be a low molecular weight or high molecular weight compound.

Examples of the organic solvent include aromatic carboxylic acid esters (such as dibutyl phthalate, diphenyl phthalate and phenyl benzoate); aliphatic carboxylic acid esters (such as dioctyl adipate, dibutyl sebacate, methyl stearate, dibutyl maleate, dibutyl fumarate and triethyl acetylcitrate); phosphoric acid esters (such as trioctyl phosphate and tricresil phosphate); epoxy compounds (such as epoxylated soy bean oil and epoxylated fatty acid methyl esters); alcohols (such as stearyl alcohol, ethyleneglycol, propyleneglycol, diethyleneglycol, triethyleneglycol, glycerin, diethyleneglycol monobutylether (DEGMBE), triethyleneglycol monobutylether, glycerin monomethylether, 1,2,3-butanetriol, 1,2,4-butanetriol, 1,2,4-pentanetriol, 1,2,6-hexanetriol, thiodiglycol, triethanolamine and polyethyleneglycol); vegetable oils (such as soy bean oil and sunflower oil); and higher aliphatic carboxylic acid (such as linoleic acid and oleic acid).

<Substrate>

Either transparent substrates made of transparent materials such as plastics, or opaque substrates made of opaque materials such as paper sheets may be used as the substrate of the invention. The transparent substrate or highly glossy opaque substrate is preferably used for taking advantage of transparency of the ink receiving layer. Alternatively, read-only optical disks such as CD-ROM and DVD-ROM, write-once optical disks such as CD-R and DVD-R, and rewritable optical disks may be used as the substrate with the ink receiving layer applied at the labeling face side.

The materials used for the transparent substrate are preferably transparent and resistant to radiant heat generated suffered in uses in an OHP and backlight display. The preferable materials thereof include polyesters such as polyethylene terephthalate; polysulfone, polyphenylene oxide, polyimide, polycarbonate and polyamide. Polyesters are preferable, and polyethylene terephthalate is particularly preferable among them.

While the thickness of the substrate is not particularly restricted, it is preferably 50 to 200 μm from the viewpoint of handling performance.

The opaque substrate having high glossiness preferably has a glossiness of 40% or more. The glossiness is measured according to a 75 degree specular glossiness test method of paper sheets and paper board (JIS P-8142). Specific examples of the substrate are as follows.

They are, for example, highly glossy paper substrates such as art paper, coat paper, cast-coat paper, and barite paper used for silver salt photographic substrate; highly glossy films made to be opaque by adding a white pigment and the like in plastic films such as polyesters such as polyethylene terephthalate (PET), cellulose esters such as nitrocellulose, cellulose acetate and cellulose acetate butylate, polysulfone, polyphenylene oxide, polyimide, polycarbonate and polyamide (a calender treatment may be applied on the surface); and substrates having coated layers of polyolefin containing or not containing the white pigment on the surfaces of the various paper substrates, transparent substrates and highly glossy films containing the white pigment.

Foamed polyester films containing the white pigment (for example foamed PET that contains polyolefin fine particles, and in which voids are formed by stretching) are also favorably used. Resin coat paper used for the silver salt photographic printing paper is also favorably used.

While the thickness of the opaque substrate is not particularly restricted, it is preferably 50 to 300 μm considering handling performance.

A corona discharge treatment, glow discharge treatment, flame treatment or UV irradiation treatment may be applied on the surface of the substrate for improving wettability and adhesive property.

The raw paper sheet used for resin coat paper will be described in detail below.

The raw paper is produced using a wood pulp as a major material, and by adding a synthetic pulp such as polypropylene pulp, or synthetic fibers such as nylon or polyester fibers, into the wood pulp, if necessary. While any one of LBKP, LBSP, NBKP, NBSP, LDP, NDP, LUKP and NUKP may be used as the wood pulp, LBKP, NBSP, LBSP, NDP and LDP abundant in short fibers are preferably used.

However, the proportion of LBS and/or LDP is preferably 10% by mass or more and 70% by mass or less.

Chemical pulps (sulfate pulp and sulfite pulp) containing few impurities are preferably used, and the pulp having improved brightness by applying a bleaching treatment is also useful.

A sizing agent such as a higher fatty acid and alkylketene dimer; white pigment such as calcium carbonate, talc and titanium oxide; a paper strength enhancer such as starch, polyacrylamide and polyvinyl alcohol; a fluorescent brightener; a humectant such as polyethyleneglycol; a dispersing agent; and a softening agent such as quaternary ammonium may be appropriately added in the raw paper sheet.

The degree of water filtration of the pulp used is 200 to 500 ml as defined in CFS. The fiber length after beating is defined as a value measured by a sieve classification method according to JIS P-8207, and the sum of the percentage by mass of the 24 mesh filtration residue and the percentage by mass of the 42 mesh filtration residue is preferably 30 to 70% by mass. The percentage by mass of the 4 mesh filtration residue is preferably 20% by mass or less.

The average weight of the raw paper sheet is preferably 30 to 250 g/m$^2$, particularly 50 to 200 g/m$^2$. The thickness of the raw paper is preferably 40 to 250 μm. The raw paper sheet may be highly lubricated by applying a calender treatment during the paper making process of after the paper making process. The density of the raw paper is usually 0.7 to 1.2 g/m$^2$ (JIS P-8118).

The rigidity of the raw paper is preferably 20 to 200 g under the condition according to JIS P-8143.

A surface sizing agent may be applied on the surface of the raw paper sheet, and the same sizing agent as added in the raw paper sheet may be used as the surface sizing agent.

The pH of the raw paper sheet is preferably 5 to 9 as measured by a hot water extraction method according to JIS P-8113.

While polyethylene used for coating the surface and back face of the raw paper sheet is low density polyethylene (LDPE) and/or high density polyethylene (HDPE), LLDPE, polypropylene and the like may be partly used.

Titanium oxide of rutile or anatase type, fluorescent whitener and ultramarine blue are preferably added into the polyethylene layer that forms the ink receiving layer to improve opaqueness, whiteness, and hue, as widely adopted in photographic printing paper sheets. The content of titanium oxide is preferably 3 to 20% by mass, more preferably 4 to 13% by mass, relative to polyethylene. While the thickness of the polyethylene layer is not particularly restricted, a thickness of 10 to 50 μm is favorable for both the top and back surface layers. An undercoat layer may be provided on the polyethylene layer for endowing the polyethylene layer with an adhesive property to the ink receiving layer. Aqueous polyester, gelatin and PVA are preferably used as the undercoat layer. The thickness of the undercoat layer is preferably 0.01 to 5 μm.

The polyethylene coated paper sheet may be used as glossy paper, or by forming a matte surface or silky surface that are obtainable in usual photographic printing paper sheets by applying an embossing treatment when polyethylene is coated on the raw paper sheet by melt-extrusion. extrusion.

A back coat layer may be provided on the substrate, and examples of the components capable of adding to the back coat layer include a white pigment, aqueous binder and the like.

Examples of the white pigment contained in the back coat layer include inorganic white pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, ritpon, zeolite, hydrated halloysite, magnesium carbonate and magnesium hydroxide; and organic pigments such as styrene plastic pigments, acrylic plastic pigments, polyethylene, microcapsules, urea resin and melamine resin.

Examples of the aqueous binders used for the back coat layer include water soluble polymers such as styrene/maleic acid copolymer, styrene/acrylate copolymer, polyvinyl alcohol, silanol modified polyvinyl alcohol, starch, cation starch, casein, gelatin, carboxymethyl cellulose, hydroxyethyl cellulose and polyvinyl pyrrolidone; and water dispersible polymers such as styrene-butadiene latex and acrylic emulsion.

Other components contained in the back coat layer include defoaming agents, foaming suppressing agents, dyes, fluorescent brighteners, antiseptics and water-proofing agent.

<Preparation of Ink-Jet Recording Layer>

The ink receiving layer of the ink jet recording medium of the invention is preferably formed, for example, by applying the coating liquid A containing at least the fine particles and water soluble resin on the surface of the substrate, and applying coating liquid B having a pH value of greater than 7 (1) at substantially the same time that the coating liquid is applied, or (2) during drying the coated layer formed by applying the coating liquid, and before the coated layer exhibits a decreasing rate of drying, followed by cross-linking and hardening the coated layer formed by applying the coating liquid B. While the polymer of the invention may be contained in at least one of the coating liquid A and B, the polymer is preferably contained in the coating liquid A for improving ink absorbing property.

The cross-linking agent capable of cross-linking the water soluble resin may also be added in at least one of the coating liquid A and B.

Providing the ink receiving layer cross-linked and hardened described above is preferable from the viewpoint of ink absorbing property and for protection of the layer from cracking.

The process described above is preferable since the colorant in the ink-jet is sufficiently fixed and colored due to a large quantity of mordant is present in a desired portion of the ink receiving layer. Therefore, Color density, resistance to bleeding over time, glossiness, and water resistance and ozone resistance of letters and images after printing are improved. A part of the mordant may be added in the layer that is provided on the substrate at first, and the mordant added thereafter may be the same as or different from the first mordant.

The coating liquid for the ink receiving layer(coating liquid A) containing at least the fine particles (for example gas phase silica) and water soluble resin (for example polyvinyl alcohol) can be prepared as follows.

The fine particles such as gas phase silica and a dispersing agent are added in water (for example at a concentration of the silica fine particles of 10 to 20% by mass), and are dispersed for 20 minutes (preferably 10 to 30 minutes) at a high rotation speed of 10,000 rpm (preferably 5,000 to 20,000 rpm) using a high speed wet colloid mill (for example Clear Mix manufactured by M technique Co., Ltd.). Then, an aqueous polyvinyl alcohol (PVA) solution is added to the dispersion solution so that, for example, the mass PVA is about ⅓ of the mass of gas phase silica, and the mixed solution is dispersed under the same rotation condition as described above. It is preferable for stabilizing the coating liquid to adjust the pH at about 9.2 with aqueous ammonia, or to use a dispersing agent. The coating liquid is obtained as a homogeneous sol, and a porous ink receiving layer having a three dimensional network structure is formed by applying the coating liquid on the substrate by the application method described below followed by drying.

The aqueous dispersion composed by the gas phase silica particles and dispersing agent may be prepared by preparing an aqueous dispersion of gas phase silica first followed by adding the aqueous dispersion into an aqueous solution of the dispersing agent. Alternatively, the aqueous solution of the dispersing agent may be added to the aqueous dispersion of gas phase silica, or both solutions may be simultaneously mixed. A gas phase silica powder may be added to the aqueous solution of the dispersing agent, instead of adding the aqueous dispersion of gas phase silica.

An aqueous dispersion containing particles with an average particle diameter of 50 to 300 nm can be obtained by pulverizing the mixed solution using a dispersion machine after mixing the gas phase particles with the dispersing agent. While the dispersion machine available include various conventional dispersion machines such as a high speed rotation dispersion machine, medium stirring dispersion machine (ball mill, sand mill and the like), a ultrasonic dispersion machine, colloid mill dispersion machine and high pressure dispersion machine, the medium stirring dispersion machine, colloid mill dispersion machine and high pressure dispersion machine are preferable for effecting dispersion of coagulated fine particles.

The solvents available in each step are water, organic solvents or mixtures thereof. The organic solvents available for coating include alcohols such as methanol, ethanol, n-propanol, i-propanol and methoxypropanol, ketones such as acetone and methylethyl ketone, tetrahydrofuran, acetonitrile, ethyl acetate and toluene.

The dispersing agent may be added for improving dispersability of the coating liquid. The cationic dispersing agent is preferably used as the dispersing agent.

The amount of addition of the dispersing agent is preferably 0.1 to 30%, more preferably 1 to 10%, relative to the amount of the fine particles.

While the pH of the coating liquid is not particularly restricted, it is preferably 2 or more and 6 or less, more preferably 3 or more and 5 or less. Bleeding over time of the image may be suppressed by forming the ink receiving layer from the coating liquid having a pH value of 2 or more and 6 or less.

The ink receiving layer coating liquid can be applied by a known coating method using an extrusion die coater, air doctor coater, blade coater, rod coater, knife coater, squeeze coater, reverse roll coater and bar coater.

While the coating liquid B is applied at substantially the same time of or after applying the coating liquid for ink receiving layer (coating liquid A), the coating liquid B may be applied before the coated layer after application exhibits a decreasing rate of drying. In other words, the ink receiving layer is favorably produced by introducing the coating liquid B while the coated layer exhibits a constant rate drying after applying the coating liquid for the ink receiving layer (coating liquid A). A dye may be contained in the coating liquid B.

The phrase "before the coated layer exhibits a decreasing rate of drying" as used herein usually means a lapse of time of several minutes from immediately after application of the ink receiving layer coating liquid. The "constant rate drying" phenomenon in which the content of the solvent (dispersion medium) in the applied coated layer is reduced in proportion to the lapse of time appears during this period. The period exhibiting the "constant rate drying" is described in Kagaku Kogaku Binran (Handbook of Chemical Engineering; pp. 707-712, Maruzen Co., Ltd., Oct. 25, 1980).

While the ink receiving layer is dried until the coated layer exhibits a decreasing rate of drying after applying the coating liquid A, this drying period is usually 0.5 to 10 minutes (preferably 0.5 to 5 minutes) at 40 to 180° C. Although the drying period is naturally different depending on the amount of coating, the range above is usually appropriate.

Examples of the application method before the first coated layer exhibits a decreasing rate of drying include (1) a method for additionally applying the coating liquid B on the coated layer, (2) a spraying method, and (3) a method for dipping the substrate comprising the coated layer thereon in the coating liquid B.

The method available for applying the coating liquid B in the method (1) include the methods known in the art using a curtain flow coater, extrusion die coater, air doctor coater, blade coater, rod coater, knife coater, squeeze coater, reverse roll coater and bar coater. However, the methods using the extrusion die coater, curtain flow coater and bar coater are preferable since these method is able to apply without making no direct contact on the already formed first coated layer.

The ink receiving layer is usually heated at 40 to 180° C. for 0.5 to 30 minutes for drying and hardening after applying the coating liquid B. Heating at 40 to 150° C. for 1 to 20 minutes is particularly preferable.

When the coating liquid B is applied at substantially the same time of applying the coating liquid for the ink receiving layer (coating liquid A), coating liquid A and coating liquid B are simultaneously applied (dual layer application) on the substrate so that coating liquid A contacts the substrate, followed by forming the ink receiving layer by hardening by drying thereafter.

Above-described simultaneous application (dual layer application) can be performed by the coating method using the extrusion die coater, the curtain flow coater, and the like. While the coated layer formed is dried after the simultaneous application, the layer is usually dried by heating at 40 to 150° C. for 0.5 to 10 minutes, preferably at 40 to 100° C. for 0.5 to 5 minutes.

When the coating liquids are applied so as to form a dual layer with the extrusion die coater, for example, the dual layer is formed in the vicinity of the discharge port of the extrusion die coater by simultaneously discharging the two kinds of the coating liquids before being transferred onto the substrate, in order to directly form the dual coated layer. Since the two kinds of the coating liquids in the dual layer before application tends to form cross-links at the interface between the two solutions before being transferred onto the substrate, the two solutions are liable to be thickened by being mixed with each other in the vicinity of the discharge port of the extrusion die coated. Consequently, the application work may be difficult. Accordingly, it is preferable to simultaneously form a triple layer by permitting a barrier layer solution (an intermediate layer solution) to interpose between the two coating liquids A and B.

The barrier layer solution may be selected without any restrictions including, for example, an aqueous solution containing a trace amount of an water soluble resin and water. The water soluble resin is added as a thickener for improving coating performance. Examples of the water soluble resin include cellulose resins (such as hydroxylpropylmethyl cellulose, methyl cellulose and hydroxyethyl cellulose), polyvinyl pyrrolidone and gelatin. The dye mordant may be added to the barrier layer solution.

The surface smoothness, glossiness, transparency and coated layer strength may be improved by applying a calender treatment by passing the sheet through roll nips by heating with compression using a super calender or gloss calender machine after forming the ink receiving layer is formed on the substrate. However, since the calender treatment may cause a decrease of the void ratio (or decrease or ink absorbing property), a condition giving small decrease of the void ratio should be employed.

The roll temperature for applying the calender treatment is preferably 30 to 150° C., more preferably 40 to 100° C.

The linear pressure between the rolls for calender treatment is preferably 50 to 400 kg/cm, more preferably 100 to 200 kg/cm.

Since the ink receiving layer is required to have a thickness that renders an absorption capacity enough for absorbing all the droplets in the ink-jet recording, the thickness should be determined in relation to the void ratio in the layer. For example, the thickness should be about 15 μm or more when the amount of the ink is 8 nL/mm$^2$ and the void ratio is 60%.

The thickness of the ink receiving layer is preferably 10 to 50 μm for ink-jet recording considering the conditions above.

The diameter of the void in the ink receiving layer is preferably 0.005 to 0.030 μm, more preferably 0.01 to 0.25 μm, in a median diameter.

The void ratio and median diameter can be measured using a mercury porosimeter (trade name: Poresizer 9320-PC2, manufactured by Shimadzu Corporation).

The pH of the surface of the ink receiving layer of the invention is preferably 3 or more and 7 or less, more preferably 3 or more and 5 or less. The pH on the surface is measured 30 seconds after dripping distilled water according to the J. TAPPI Paper and Pulp Test Method No. 49. Image preservability is improved when the pH is 3 or more, while water resistance is improved when the pH is 7 or less to enable bleeding under a high temperature high humidity condition to be suppressed. Accordingly, resistance to bleeding over time, ozone resistance and light fastness may be improved when the pH of the surface is 3 or more and 7 or less.

While it is preferable that the ink receiving layer is excellent in transparency, the criterion of transparency is that the ink receiving layer formed on a transparent film substrate preferably has a haze value of 30% or less, more preferably 20% or less.

The haze value is measured using a haze meter (trade name: HGM-2DP, manufactured by Suga Test Instrument Co., Ltd.).

A Dispersion of polymer fine particles may be added to the constituting layers of the ink jet recording medium of the invention (for example the ink receiving layer or back layer). This polymer fine particle dispersion is used for improving film properties such as dimensional stability, curl prevention property, adhesion prevention property and crack prevention property. The polymer fine particle dispersion is described in JP-A Nos. 62-245258, 62-1316648 and 62-110066. Cracking and curling of the layer can be prevented by adding a polymer fine particle dispersion having a low glass transition temperature (40° C. or less) in the layer containing the mordant.

Curling may be also prevented by adding a polymer fine particle dispersion having a high glass transition temperature to the back layer.

The ink jet recording medium of the invention can be also manufactured by the methods described in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091 and 8-2093.

EXAMPLES

While the present invention is described in detail with reference to examples, the invention is by no means restricted to these examples. "Parts" and "%" in the examples mean "parts by mass" and "% by mass" unless otherwise stated, and "average molecular weight" and "degree of polymerization" represent "mass average molecular weight" and "mass average degree of polymerization".

Synthesis Example

Synthesis Example 1

Dissolved in 13.5 parts of a ethyl acetate/isopropanol (1/1) mass mixed solution were 13.5 parts of polybutadiene (NISSO-PB G1000 manufactured by Nippon Soda Co., Ltd.), 15.6 parts of 2-mercaptoethanol and 2.84 parts of aminoethanethiol hydrochloride. This solution was heated at 70° C. in a nitrogen stream, 0.062 parts of 2,2-azobis(2,4-dimethylvaleronitrile) (V-65 manufactured by Wako Pure Chemical Industries, Inc.) was added, and stirred by heating at 70° C. 0.062 parts of V-65 was further added after 2 hours, and stirring was continued for 4 hours at 70° C.

An emulsion of polymer 1 (example compound P-6, sulfur equivalent 7.18 meq/g, I/O value 1.17) was obtained after emulsifying by uniformly adding 128 parts of ion-exchange water.

Synthesis Example 2

An aqueous solution of polymer 2 (example compound P-7, sulfur equivalent 5.47 meq/g, I/O value 1.74) was obtained by the same method as in Synthesis Example 1, except that 15.6 parts of 2-mercaptoethanol in Synthesis Example 1 was changed to 21.6 parts of α-thioglycerol.

Synthesis Example 3

An emulsion of polymer 3 (example compound P-10, sulfur equivalent 6.88 meq/g, I/O value 1.13) was obtained by the same method as in Synthesis Example 1, except that 2.84 parts of aminoethanethiol hydrochloride in Synthesis Example 1 was changed to 3.54 parts of N,N-dimethylethanethiol hydrochloride.

Synthesis Example 4

An aqueous solution of polymer 4 (example compound P-9, sulfur equivalent 5.76 meq/g, I/O value 1.79) was obtained by the same method as in Synthesis Example 3, except that the amount of use of 15.6 parts of 2-mercaptoethanol and the amount of use of 3.54 parts of N,N-dimethylethane thiol in Synthesis example 3 were changed to 7.81 parts and 17.7 parts, respectively.

Synthesis Example 5

An emulsion of polymer 5 (example compound P-1, sulfur equivalent 7.23 meq/g, I/O value 0.94) was obtained by the same method as in Synthesis Example 1, except that the amount of use of mercaptoethanol in Synthesis Example 1 was changed to 17.6 parts, and no aminoethanethiol hydrochloride was added.

Synthesis Example 6

An emulsion of polymer 6 (example compound P-12, sulfur equivalent 6.51 meq/g, I/O value 1.08) was obtained by the same method as in Synthesis Example 3, except that the amount of use of 2-mercaptoethanol of 15.6 parts in Synthesis Example 3 was changed to 13.7 parts.

Synthesis Example 7

An emulsion of polymer 7 (example compound P-8, sulfur equivalent 6.70 meq/g, I/O value 1.41) was obtained by the same method as in Synthesis Example 1, except that 2.84 parts of aminoethanethiol hydrochloride in Synthesis Example 1 was changed to 4.45 parts of sodium 2-mercaptpropan sulfonate.

Synthesis Example 8

Dissolved in 52 parts of ethanol were 10.7 parts of acrylamide and 6.49 parts of pentaerythritol tetra(mercaptoacetate), and the solution was heated at 70° C. in nitrogen stream. Added in this solution was 0.0745 parts of 2,2-azobis(2,4-dimethylvalelonitrile) V-65, and the solution was heated at 70° C. for 4 hours with stirring.

A white solid of polymer 8 (example compound P-16, sulfur equivalent 3.49 meq/g, I/O value 2.66) was obtained by filtering the precipitate formed.

Synthesis Example 9

A white solid of polymer 9 (example compound P-14 having a different molecular weight, sulfur equivalent 4.70 meq/g, I/O value 2.92) was obtained by the same method as in Synthesis Example 8, except that 6.49 parts of pentaerythritol tetra(mercaptoacetate) in Synthesis Example 8 was changed to 2.07 parts of di(2-mwrcaproethyl)ether.

Synthesis Example 10

A white solid of polymer 10 (sulfur equivalent 1.27 meq/g, I/O value 3.24) as a comparative example having the following structural formula was obtained by the same method as in Synthesis Example 8, except that 6.49 parts of pentaerythritol tetra(mercaptoacetate) in Synthesis Example 8 was changed to 0.938 parts of 2-mercaptoethanol.

Polymer 10

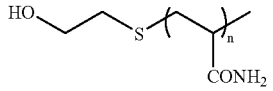

Synthesis Example 11

A white solid of polymer 11 (sulfur equivalent 1.09 meq/g, I/O value 1.55) as a comparative example having the following structural formula was obtained by the same method as in Synthesis Example 8, except that 10.7 parts of acrylamide in Synthesis Example 8 was changed to 48.8 parts of hydroxyethyl acrylate.

Polymer 11

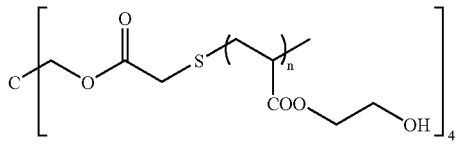

(Preparation of Substrate)

A wood pulp comprising 100 parts of LBKP was beaten to Canadian Standard Freeness of 300 ml using a double discrefiner. Then, 0.5 parts of epoxylated behenamide, 1.0 part of anionic polyacrylamide, 0.1 parts of polyamide polyamine epichlorohydrin and 0.5 parts of cationic polyacrylamide in absolute dry mass ratios to the pulp. A raw paper sheet with an area density of 170 g/m$^2$ was produced using a Fourdrinier paper machine.

For adjusting surface sizing of the raw paper, the base paper was impregnated with a solution prepared by adding 0.04% of a fluorescent whitener (Whitex BB manufactured by Sumitomo Chemical Co., Ltd.) in 4% aqueous polyvinyl alcohol so that the area density thereof is 0.5 g/m$^2$ as converted into the absolute dry mass of the paper. The raw paper was subjected to calender treatment after drying to obtain a base paper adjusted to a density of 1.05 g/ml.

After subjecting the wire surface (back surface) of the base paper obtained to corona discharge, high density polyethylene was coated to a thickness of 19 μm using a melt extruder to form a resin layer comprising a mat surface (the resin surface is referred to a back face hereinafter). The resin layer on the back face was further subjected to corona discharge treatment, and a dispersion solution prepared by dispersing aluminum oxide (Alumina Sol 100 manufactured by Nissan Chemical Industries, Ltd.) and silicon dioxide (Snowtex O manufactured by Nissan Chemical Industries, Ltd.) in 1:2 mass ratio was applied so that the dry mass of the layer is 0.2 g/m$^2$.

After applying the corona treatment on the felt surface (top surface) having no resin layer, low density polyethylene, which contains 10% of anatase type titanium dioxide, a minute amount of ultramarine blue and 0.01% (relative to polyethylene) of fluorescent whitener, with a melt flow rate (MFR) of 3.8 was extruded at a thickness of 29 μm using a melt extruder to form a substrate having a high glossiness thermoplastic layer on the top surface of the base paper sheet.

Example 1

(Preparation of Ink Receiving Layer Coating Liquid A)

Mixed and dispersed using a high speed colloid mill (trade name: KD-P, manufactured by Shinmaru Enterprises Corporation) were (1) gas phase silica, (2) ion-exchange water and (3) Sharoll DC-902P (trade name) in the following compositions, and ink receiving layer A was prepared by adding a solution containing (4) zirconyl acetate, (5) aqueous boric acid solution, (6) polyvinyl alcohol, (7) surfactant, (8) polymer 1 and (9) ion-exchange water in the following compositions.

The mass ratio between the silica fine particles and water soluble resin (PB ratio=(1)/(7)) was 4.5, and ink receiving layer coating liquid was acidic with a pH value of 3.5.

<Composition of Ink Receiving Layer Coating Liquid A>

(1) gas phase silica fine particles (inorganic fine particles) ("Rheoseal QS-30" manufactured by Tokuyama Corp., average primary particle diameter 7 nm) 10.0 parts (2) ion-exchange water 51.6 parts (3) "Sharoll DC-902P" (51% aqueous solution) (dispersing agent, manufactured by Dai-ichi Kogyo Seiyaku Co., Ltd.) 1.0 part (4) zirconyl acetate (25% aqueous solution) 0.3 parts (5) aqueous boric acid solution (5% solution, cross-linking agent) 8.0 parts (6) polyvinyl alcohol (8% aqueous solution, water soluble resin) ("PVA 235" manufactured by Kuraray Co., Ltd., degree of saponification 88%, degree of polymerization 3500) 27.8 parts (7) surfactant ("Emulgen" 109P manufactured by Kao Corp., 2% aqueous solution, HLB 13.6) 0.1 parts (8) polymer 1 (25% emulsion) 2.5 parts (9) ion-exchange water 23.1 parts (Preparation of Ink Jet Recording Medium (Sheet))

After the corona discharge treatment of the top surface of the substrate, ink receiving layer coating liquid B obtained above was applied on the top surface of the substrate in a density of 200 ml/m$^2$ using an extrusion die coater (coating step), and the layer was dried to a solid fraction concentration of 20% with a hot-air drier (air speed 3 to 8 m/sec). The coated layer showed a constant rate of drying during this drying period. The substrate was immersed in coating liquid B having the composition below for 30 seconds immediately after drying, to adhere coating liquid B (pH 9.3) on the coated layer above at a density of 20 g/M$^2$ (mordant solution adhering step), followed by drying at 80° C. for 10 minutes (drying step). Ink-jet recording sheet (1) of the invention having an ink receiving layer with a dry thickness of 32 μm was obtained.

<Composition of Coating Liquid B>

(1) boric acid (cross-linking agent) 0.65 parts (2) ammonium zirconium carbonate ("Zircosol AC-7" manufactured by DAIICHI KIGENSO KAGAKU KOGYO CO., LTD., 28% aqueous solution) 6.5 parts (3) ammonium carbonate 6.0 parts (4) ion-exchange water 83.8 parts (5) surfactant ("Megafac F-1405" manufactured by Dainippon Ink & Chemicals, Inc.) 0.2 parts

Examples 2 to 6

Ink-jet recording sheets (2) to (6) of the invention were manufactured by the same method as in Example 1, except that polymer 1 used for preparing ink receiving layer coating liquid A in Example 1 was changed to polymers 2 to 6.

Example 7

Ink-jet recording sheet (7) of the invention was manufactured by the same method as in Example 1, except that 0.6 parts of poly-aluminum chloride (40% aqueous solution, basic structural formula $Al_2(OH)_5Cl$) was further added to ink receiving layer coating liquid A in Example 1.

Examples 8 to 15

Ink-jet recording sheets (8) to (15) of the invention were manufactured by the same method as in Example 1, except that polymer 1 used for preparing ink receiving layer coating liquid A in Example 7 was changed to polymer 2 to 9.

Example 16

Ink-jet recording sheet (16) of the invention was manufactured by the same method as in Example 1, except that coating liquid B in Example 1 was changed to coating liquid C having the following composition.

<Composition of Coating Liquid C>

(1) boric acid (cross-linking agent) 0.65 parts (2) polyallylamine "PAA-10C" 10% aqueous solution (mordant, manufactured by Nittobo Co.) 25 parts (3) ion-exchange water 59.7 parts (4) ammonium chloride (surface pH controlling agent) 0.8 parts (5) polyoxyethylene laurylether (surfactant) ("Emulgen 109P" manufactured by Kao Corp., 2% aqueous solution, HLB 13.6) 10 parts (6) "Megaface F1405" 10% aqueous solution (fluorinated surfactant, manufactured by Dainippon Ink & Chemicals, Inc.) 2.0 parts Comparative Example 1 to 3

Comparative ink-jet recording sheets (17) to (19) were manufactured by the same method as in Example 1, except that polymer 1 used in ink receiving layer A in Example 1 was changed to the following compounds A to C.

Compound A

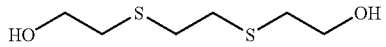

(S equivalent 11.0 meq/g, I/O value 1.75)

Compound B

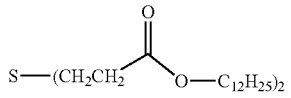

(S equivalent 1.94 meq/g, I/O value 0.258)

Compound C

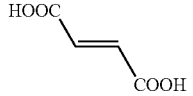

Ink-jet recording sheet (20) of the comparative example was manufactured by the same method as in Example 1, except that polymer 1 used in ink receiving layer coating liquid D in Example 1 was changed to a mixture of compounds A and C (A:C=1:1, mass ratio).

Comparative Example 5

Ink-jet recording sheet (21) of the comparative example was manufactured by the same method as in Example 1, except that polymer 1 used in ink receiving layer coating liquid A in Example 1 was changed to poly(2-methacryloyloxyethyl)trimethylammonium chloride.

Comparative Example 6

Ink-jet recording sheet (22) of the comparative example was manufactured by the same method as in Example 1, except that polymer 1 used in ink receiving layer coating liquid A in Example 1 was changed to polybutadiene latex.

Comparative Examples 7 to 10

Ink-jet recording sheets (23) to (26) of the comparative example were manufactured by the same method as in Example 7, except that polymer 1 used in ink receiving layer coating liquid A in Example 1 were changed to compounds A to C, and compound D below.

Compound D

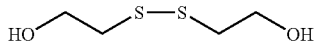

(S equivalent 13.0 meq/g, I/O value 2.33)

Comparative Example 11

Ink-jet recording sheet (27) of the comparative example was manufactured by the same method as in Example 7, except that polymer 1 used in ink receiving layer coating liquid A in Example 7 was changed to poly(2-methacryloyloxyethyl)trimethylammonium chloride.

Comparative Example 12

Ink-jet recording sheet (28) of the comparative example was manufactured by the same method as in Example 7, except that polymer 1 used in ink receiving layer coating liquid A in Example 7 was changed to polybutadiene latex.

Comparative Examples 13 and 14

Ink-jet recording sheets (29) and (30) of the comparative example were manufactured by the same method as in Example 7, except that polymer 1 used in ink receiving layer coating liquid A in Example 7 was changed to polymers 10 and 11.

Comparative Example 15

Ink-jet recording sheet (31) of the comparative example was manufactured by the same method as in Example 7, except that polymer 1 used in ink receiving layer coating liquid A in Example 7 was changed to deionized water.

(Evaluation Test)

Ink-jet recording sheets (1) to (16) of the invention obtained above, and comparative ink-jet recording sheets (17) to (31) were evaluated as follows. The results of the tests are shown in Table 1.

(Glossiness)

60° glossiness of each ink-jet recording sheet before printing was measured using a digital angle-variable gloss meter (UGV-50DP manufactured by Suga Test Instrument Co., Ltd.

The sheets having glossiness of 45° or more and 55° or less, 35° or more and less than 45°, and less than 35° were evaluated as A, B and C.

(Precipitation Test)

Each ink-jet recording sheet was preserved at 5° C. for 10 days. The amount of precipitates on the surface of the ink-jet recording sheet was observed by the naked eye thereafter.

The sheets on which no precipitates were observed, a small amount of precipitates were observed but practically no problem, and many precipitates were observed with no practical applicability were evaluated as A, B and C, respectively.

(Ink Absorbing Property)

Solid images of Y (yellow), M (magenta), C (cyan), K (black), B (blue) G (green) and R (red) were printed on the ink-jet recording sheet obtained above using an ink-jet printer (PM-950C manufactured by Seiko Epson Corporation). A sheet of paper was pressed onto the image immediately after printing (about 10 second after), and transfer of each color of the ink onto the paper sheet was observed by the naked eye to evaluate ink absorbing property according to the following criteria. No observation of transfer of the ink onto the paper sheet shows that ink absorbing rate is good.

No transfer of the ink onto the paper sheet at all, a partial ink transfer onto the paper sheet, and a considerable amount of ink transfer onto the paper sheet with no practical applicability were evaluated as A, B and C, respectively.

(Bleeding Over Time)

A lattice of linear patterns (line width 0.28 mm) was printed on each ink-jet recording sheet using an ink-jet printer so that lines of a magenta ink and lines of a black ink were printed in adjoining relation to one another, and visual densities ($OD_{fresh}$) were measured using Xrite 310TR (manufactured by X-Rite Incorporated.). Each printed ink-jet printing sheet after was inserted into a clear file after the measurement, and the file was stored in a constant temperature constant humidity chamber for 3 days under a relative humidity of 80% at 35° C. The visual density ($OD_{fresh}$) was measured again after the storage, and the rate of change of the density $[(OD_{thermo}-OD_{fresh})/OD_{fresh}]\times 100$ was calculated. The rate of change of densities of less than 20%, 20% or more and less than 40%, and 40% or more were evaluated as A, B and C, respectively. The smaller rate of change of the density shows smaller (better) bleeding over time.

(Light Fastness)

Solid images of magenta and cyan were printed on each ink-jet recording sheet using an ink-jet printer (PM-950C manufactured by Seiko Epson Corporation). Then, a lamp was turned on for 3.8 hours in an environment of a temperature of 25° C. and a relative humidity of 32% through a filter blocking a UV rays having a wavelength region of 365 nm or less using Xenon Weather-meter Ci65A (manufactured by ATLAS Co.), followed by leaving the recording sheet for. 1 hour in an environment of a temperature of 20° C. and a relative humidity of 91% while the lamp is turned off. This cycle was continued for 168 hours. The densities of each color before and after the test were measured with a reflection density meter (Xrite 938, manufactured by X-Rite Incorporated.), and residual ratios of each color density were calculated.

The residual ratios of magenta densities of 90% or more, 80% or more and less than 90%, 70% or more and less than 80%, and less than 70% were evaluated as A, B, C and D, respectively.

(Ozone Resistance)

Solid images of cyan was printed on each ink-jet recording sheet using an ink-jet printer (PM-950C, manufactured by Seiko Epson Corporation), and the sheet was stored in an environment containing 2.5 ppm of ozone. The cyan densities before and after the storage were measured using a reflection densitometer (Xrite 938, manufactured by X-Rite Incorporated.).

The sheets having color survival ratios of 85% or more, 75% or more and less than 85%, 65% or more and less than 75%, and less than 65% were evaluated as A, B, C and D, respectively.

TABLE 1

| | Sheet no. | Glossiness | Precipitation test | Ink Absorbing property | Bleeding over time | Light fastness | Ozone resistance Magenta | Ozone resistance Cyan |
|---|---|---|---|---|---|---|---|---|
| Example 1 | 1 | A | A | A | B | A | A | B |
| Example 2 | 2 | A | A | A | B | B | A | B |
| Example 3 | 3 | A | A | A | A | A | A | B |
| Example 4 | 4 | A | A | A | A | A | A | B |
| Example 5 | 5 | A | A | A | B | A | B | B |
| Example 6 | 6 | A | A | A | A | A | A | B |
| Example 7 | 7 | A | A | A | A | A | A | B |
| Example 8 | 8 | A | A | A | A | A | A | B |
| Example 9 | 9 | A | A | A | A | A | A | A |
| Example 10 | 10 | A | A | A | A | A | A | A |
| Example 11 | 11 | A | A | A | A | A | A | B |
| Example 12 | 12 | A | A | A | A | A | A | A |
| Example 13 | 13 | A | A | A | A | A | A | B |
| Example 14 | 14 | A | A | A | B | A | A | B |
| Example 15 | 15 | A | A | A | B | A | A | B |
| Example 16 | 16 | A | A | A | A | A | A | A |
| Comparative example 1 | 17 | A | C | A | C | B | B | B |
| Comparative example 2 | 18 | C | B | A | B | C | B | C |
| Comparative example 3 | 19 | A | A | A | B | B | C | C |
| Comparative example 4 | 20 | A | A | A | B | B | B | B |
| Comparative example 5 | 21 | A | A | A | C | B | C | C |
| Comparative example 6 | 22 | B | A | A | B | C | C | C |
| Comparative example 7 | 23 | A | C | A | C | A | B | B |
| Comparative example 8 | 24 | C | B | A | B | C | B | B |
| Comparative example 9 | 24 | C | B | A | B | B | C | B |

TABLE 1-continued

| | Sheet no. | Glossiness | Precipitation test | Ink Absorbing property | Bleeding over time | Light fastness | Ozone resistance Magenta | Ozone resistance Cyan |
|---|---|---|---|---|---|---|---|---|
| Comparative example 10 | 26 | A | C | A | C | B | C | C |
| Comparative example 11 | 27 | A | A | A | B | B | C | B |
| Comparative example 12 | 28 | B | A | A | B | C | C | C |
| Comparative example 13 | 29 | A | A | A | C | B | B | C |
| Comparative example 14 | 30 | A | A | A | B | C | C | C |
| Comparative example 15 | 31 | A | A | A | B | D | D | C |

The results in Table 1 shows that the recording media of the invention (ink jet recording sheets in Examples 1 to 16) were excellent in suppressing bleeding over time and were also excellent in ozone resistance with high color density residual ratios of the image formed after a long term storage in a high ozone concentration environment. The color density residual ratios of the image formed were also high after the cycle tests of xenon light irradiation and leaving in a high humidity environment. The recording media of the invention were shown to be excellent in light fastness, particularly in light fastness of the magenta color.

The recording media of the invention were also excellent in glossiness, ink absorbing rate, image density and water resistance.

On the contrary, the recording media in comparative examples in which no polymers of the invention were used did not show the satisfying results in ozone resistance, light fastness and bleeding over time.

Accordingly, the invention provides a recording medium having a good ink-absorbing property, being excellent in image density, having image portions excellent in light fastness, water resistance and gas resistance, and generates no bleeding over time even when subjected to long-term storage in a high-temperature/high-humidity environment.

What is claimed is:

1. A recording medium comprising a recording layer on a substrate, wherein the recording layer comprises at least one polymer that has a thioether bond, has a sulfur equivalent of no less than 1.2 meq/g, and has an inorganic/organic ratio (I/O value) represented in an organic-inorganic conceptional diagram of no less than 0.5, wherein the polymer has a partial structure represented by the following formula (1), (2), (3) or (4):

Formula (1)

wherein in the formula (1), P represents a polymer residue or oligomer residue having a repeating unit, and Y represents a single bond or a divalent linking group;

Formula (2)

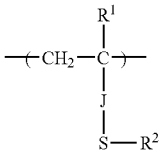

wherein in the formula (2), $R^1$ represents a hydrogen atom or a methyl group, $R^2$ represents an alkyl group or an aryl group, and J represents a single bond or a divalent linking group;

Formula (3)

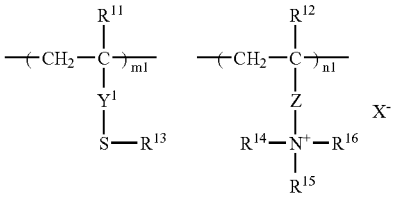

wherein in the formula (3), $R^{11}$ and $R^{12}$ each independently represent a hydrogen atom or a methyl group, $R^{13}$ represent an alkyl group or an aryl group, $R^{14}$, $R^{15}$ and $R^{16}$ each independently represent a hydrogen atom or an alkyl group, $Y^1$ and Z each independently represent a divalent linking group, $m^1$ and $n^1$ represent percentages by mole of repeating units in the polymer and satisfy relationships of $10 \leqq m^1 \leqq 95$ and $5 \leqq n^1 \leqq 90$, and $X^-$ represents a counter-anion; and Formula (4)

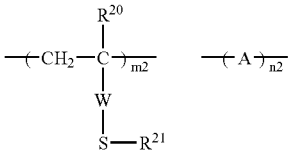

wherein in the formula (4), $R^{20}$ represents a hydrogen atom or a methyl group, $R^{21}$ represents an alkyl group or an aryl group, W represents a divalent linking group, A represents a unit having an ethylenically unsaturated group, and $m^2$ and $n^2$ represents percentages by mole of repeating units in the polymer and satisfy relationships of $50 \leqq m^2 \leqq 95$ and $5 \leqq n^{2\ 50}$.

2. A recording medium according to claim 1, wherein the sulfur equivalent of the polymer is no less than 3 meq/g.

3. A recording medium according to claim 1, wherein the polymer has water solubility or a spontaneous emulsifying property.

4. A recording medium according to claim 1, wherein the polymer is derived from a polybutadiene polymer or a polyisoprene polymer.

5. A recording medium according to claim 1, wherein the sulfur equivalent of the polymer is no less than 3 meq/g.

6. A recording medium according to claim 1, wherein the polymer has water solubility or a spontaneous emulsifying property.

7. A recording medium according to claim 1, wherein the polymer is derived from a polybutadiene polymer or a polyisoprene polymer.

8. A recording medium serving as an ink jet recording medium comprising an ink receiving layer as a recording layer on a substrate, wherein the ink receiving layer comprises at least one polymer that has a thioether bond, has a sulfur equivalent of no less than 1.2 meq/g, and has an inorganic/organic ratio (I/O value) represented in an organic-inorganic conceptional diagram of no less than 0.5, wherein the polymer has a partial structure represented by the following formula (1), (2), (3) or (4), Formula (1)

wherein in the formula (1), P represents a polymer residue or oligomer residue having a repeating unit, and Y represents a single bond or a divalent linking group;

Formula (2)

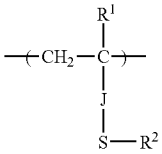

wherein in the formula (2), $R^1$ represents a hydrogen atom or a methyl group, $R^2$ represents an alkyl group or an aryl group, and J represents a single bond or a divalent linking group;

Formula (3)

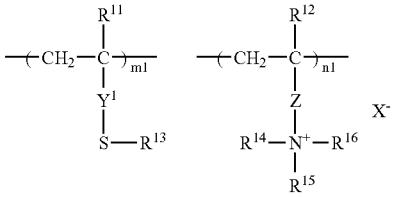

wherein in the formula (3), $R^{11}$ and $R^{12}$ each independently represent a hydrogen atom or a methyl group, $R^{13}$ represent an alkyl group or an aryl group, $R^{14}$, $R^{15}$ and $R^{16}$ each independently represent a hydrogen atom or an alkyl group, $Y^1$ and Z each independently represent a divalent linking group, $m^1$ and $n^1$ represent percentages by mole of repeating units in the polymer and satisfy relationships of $10 \leqq m^1 \leqq 95$ and $5 \leqq n^1 \leqq 90$, and $X^-$ represents a counter-anion; and Formula (4)

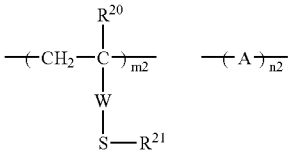

wherein in the formula (4), $R^{20}$ represents a hydrogen atom or a methyl group, $R^{21}$ represents an alkyl group or an aryl group, W represents a divalent linking group, A represents a unit having an ethylenically unsaturated group, and $m^2$ and $n^2$ represent percentages by mole of repeating units in the polymer and satisfy relationships of $50 \leqq m^2 \leqq 95$ and $5 \leqq n^{2\ 50}$.

9. A recording medium according to claim 8, wherein the sulfur equivalent of the polymer is no less than 3 meq/g.

10. A recording medium according to claim 8, wherein the polymer has water solubility or a spontaneous emulsifying property.

11. A recording medium according to claim 8, wherein the polymer is derived from a polybutadiene polymer or a polyisoprene polymer.

12. A recording medium according to claim 8, wherein the ink receiving layer further contains a water soluble resin.

13. A recording medium according to claim 8, wherein the ink receiving layer further contains fine particles.

14. A recording medium according to claim 8, wherein the ink receiving layer contains a cross-linking agent capable of cross-linking a water soluble resin.

15. A recording medium according to claim 8, wherein the ink receiving layer further contains a mordant.

16. A recording medium according to claim 8, wherein:

the ink receiving layer is obtained by cross-linking and hardening a coated layer prepared by applying a coating liquid containing the polymer, fine particles and a water soluble resin onto the substrate; and the coated layer is cross-linked and hardened by adding the cross-linking agent to at least one of the coating liquid and a basic solution having a pH value of greater than 7, and by applying the basic solution to the coating liquid (1) at substantially the same time that the coated layer is formed by applying the coating liquid, or (2) during drying of the coated layer formed by applying the coating liquid, and before the coated layer exhibits a decreasing rate of drying.

* * * * *